US007052647B2

(12) United States Patent
Fujibayashi et al.

(10) Patent No.: US 7,052,647 B2
(45) Date of Patent: May 30, 2006

(54) METHOD AND APPARATUS FOR COOLING HOT ROLLED STEEL STRIP, AND METHOD FOR MANUFACTURING HOT ROLLED STEEL STRIP

(75) Inventors: Akio Fujibayashi, Fukuyama (JP); Sadanori Imada, Fukuyama (JP); Yoshimichi Hino, Fukuyama (JP); Toru Minote, Fukuyama (JP); Yoichi Motoyashiki, Fukuyama (JP); Shozo Ikemune, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 10/793,480

(22) Filed: Mar. 3, 2004

(65) Prior Publication Data

US 2004/0201143 A1 Oct. 14, 2004

Related U.S. Application Data

(60) Division of application No. 10/046,106, filed on Oct. 24, 2001, now Pat. No. 6,733,720, which is a continuation of application No. PCT/JP01/01480, filed on Feb. 28, 2001.

(30) Foreign Application Priority Data

| | | |
|---|---|---|
| Mar. 1, 2000 | (JP) | 2000-056211 |
| Mar. 1, 2000 | (JP) | 2000-056218 |
| Oct. 16, 2000 | (JP) | 2000-315277 |
| Feb. 15, 2001 | (JP) | 2000-038710 |

(51) Int. Cl.
*C21D 1/62* (2006.01)

(52) U.S. Cl. ..... 266/114; 148/333; 148/602

(58) Field of Classification Search ..... 266/46, 266/114, 113; 148/333, 602
See application file for complete search history.

(56) References Cited

U.S. PATENT DOCUMENTS

| | | | | |
|---|---|---|---|---|
| 3,533,261 | A | 10/1970 | Hollander et al. | |
| 3,604,696 | A | 9/1971 | Coleman et al. | |
| 4,132,393 | A | 1/1979 | Nakamura et al. | |
| 4,534,198 | A * | 8/1985 | Noe et al. | 266/112 |
| 4,826,138 | A | 5/1989 | Coleman | |
| 5,065,811 | A * | 11/1991 | Scholz et al. | 164/460 |
| 5,329,688 | A * | 7/1994 | Arvedi et al. | 29/527.7 |
| 6,733,720 | B1 * | 5/2004 | Fujibayashi et al. | 266/46 |

FOREIGN PATENT DOCUMENTS

| | | |
|---|---|---|
| JP | 57-82407 U | 5/1982 |

(Continued)

*Primary Examiner*—Scott Kastler
(74) *Attorney, Agent, or Firm*—Frishauf, Holtz, Goodman & Chick, P.C.

(57) ABSTRACT

An apparatus for cooling a hot rolled steel strip comprising a transfer means arranged behind a final finishing mill, the transfer means comprising a plurality of transfer rolls for transferring the steel strip; at least one upper surface cooling means arranged at an upper surface side of the transfer means for cooling the steel strip by ejecting cooling water to an upper surface of the steel strip, the upper surface cooling means being capable of moving freely up and down and having a water breaking means at least at an outlet side of the cooling apparatus and at a position corresponding to the transfer rolls; and at least one lower surface cooling means arranged at a lower surface side of the transfer means relative to the upper surface cooling means and the steel strip to be transferred, for cooling the hot strip by ejecting cooling water at a lower surface of the steel strip.

13 Claims, 12 Drawing Sheets

FOREIGN PATENT DOCUMENTS

| | | | |
|---|---|---|---|
| JP | 59-1641 | A | 1/1984 |
| JP | 59-16617 | A | 1/1984 |
| JP | 59-16619 | A | 1/1984 |
| JP | 59-50420 | B2 | 12/1984 |
| JP | 62-260022 | A | 11/1987 |
| JP | 4-11608 | B2 | 3/1992 |
| JP | 6-328117 | A | 11/1994 |
| JP | 7-9018 | A | 1/1995 |
| JP | 9-141322 | A | 6/1997 |
| JP | 9-201614 | A | 8/1997 |
| JP | 10-58026 | A | 3/1998 |
| JP | 10-166023 | A | 6/1998 |

* cited by examiner

METHOD AND APPARATUS FOR COOLING HOT ROLLED STEEL STRIP, AND METHOD FOR MANUFACTURING HOT ROLLED STEEL STRIP

CROSS-REFERENCE TO RELATED APPLICATIONS

This application is a divisional application of application Ser. No. 10/046,106 filed Oct. 24, 2001 (U.S. Pat. No. 6,733,720), which is a continuation application of International Application PCT/JP01/01480 filed Feb. 28, 2001 (not published in English).

FIELD OF THE INVENTION

The present invention relates to an apparatus and a method for cooling a hot rolled steel strip having a high temperature and a method for manufacturing the hot rolled steel strip.

DESCRIPTION OF THE RELATED ARTS

In general, a hot rolled steel strip is manufactured in a step where a slab is heated to the specified temperature in a heating furnace and is rolled to the required thickness by a rough rolling mill to form a rough bar, and finally the resultant bar is rolled by a continuous hot rolling mill having plural rolling stands. The hot rolled steel strip is cooled at a cooling stand on a runout table and then is coiled by a coiler.

An online cooling apparatus to transfer as rolled high temperature steel strip and to continuously cool before coiling by the coiler should be first designed to consider steel strip transferring ability.

For example, for cooling an upper surface of the steel strip, circular laminar cooling nozzles can be provided at an upper area of the steel strip transfer roll (called a roller table) and at a straight line over the width of the steel strip for ejecting plural laminar cooling water. The runout table comprises plural transfer rolls.

At this time, laminar nozzles with the same length as an axial length of the transfer roll is arranged just above the roll to prevent a steel strip path line from lowering below a line connecting upper contact points of the transfer roll even when pressing the steel strip by water pressure of the falling down cooling water. In addition, spray nozzles are arranged between transfer rolls to eject cooling water upward for cooling the lower surface of the steel strip.

Therefore, this cooling mode does not ensure an exact symmetrical cooling for the upper and lower surface of the steel strip, resulting in intermittent cooling especially at the upper surface of the steel strip. This makes a rapid cooling (for example, cooling speed of 200° C./sec or more for 3 mm in sheet thickness) impossible practically.

Recently, the rapid (strong) cooling, however, has been required to produce the hot rolled steel strip with fine grain size because of excellent machinability and to manufacture low Ceq high strength product.

Upon rapid cooling of the hot rolled steel strip, the conventional cooling apparatus has been involved in the following problems.

At rapid cooling, a cooling start point is different at the upper and lower surfaces of the steel strip, which causes to generate non-uniformity in material property. After cooling, cooling water remains at the upper surface of the steel strip to cause excessive cooling at the upper surface. The excessive cooling is not uniform in a longitudinal direction, resulting in variation in cooling finish temperature in this direction.

In the width direction, cooling water tends to flow from sides of the steel strip to both line sides to cause excessive cooling at the end compared with the center of the strip, fluctuating the temperature finish time. This makes material property non-uniform.

Hence, a water breaking method has been proposed such as a method to eject fluid in slant direction across the steel strip to discharge cooling water JP-A-9-141322, (the term "JP-A" referred to herein signifies "Unexamined Japanese Patent Publication") or a method using a restriction roll (called a pinch roll) as a water block roll to interrupt-cooling water, JP-A-10-166023.

However, the former method when applying strong cooling is useless because a large amount of cooling water remains on the steel strip. In the latter method, a top of the steel strip is left at a free state during transfer at the interval from the final rolling mill to the coiler, the strip passes at non-restrained state moving up and down in waving action.

As a result, the restriction roll if provided at the roller table disturbs safe passing of the strip, which is difficult to apply the roll as the cooling apparatus for the runout. Strong cooling if applied at the top of the vibrating steel strip at non-restricted state will further escalate vibration of the top end of the steel strip unavoidably to damage due to contact with the restriction roll.

On the other hand, JP-A-6-328117 proposes an effective cooling method by increasing cooling water at the steel strip top end for the lower surface than that for the upper surface. Change in the cooling water ratio, however, will unbalance the cooling effect to upper and lower surfaces especially to make unavoidably material property non-uniform. In addition, the strong cooling necessary for changing in material property is difficult because of insufficient cooling at the lower surface.

In particular, for cooling so called thinner sheet less than 2 mm in thickness, the steel strip top vibrates up and down by cooling water pressure or the steel strip tends to fold at the last half of the runout table to disturb stable passing, finally stopping the steel strip passage.

In JP-B-59-50420, (the term "JP-B" referred to herein signifies "Examined Japanese Patent Publication") a cooling water guide is arranged between plural roller tables in the frame provided in the feeding direction of the steel strip. To maintain the specified interval between the guide and steel strip surface, a press machine for the steel strip is disclosed by installing a guide roll at the guide.

This machine, however, is difficult to hold uniform interval between the cooling water guide and the steel strip surface because the steel strip top is transferred waving up and down. This method if applied for a thinner steel strip causes sticking trouble because of disturbing smooth passage at touching the steel strip top to the transfer roll.

The steel strip usually is not flat with an edge waving or center buckling. Such steel strip failed in its shape cannot be pressed by the guide roll, resulting in another leveler provided for flat shape to escalate working man-hour.

JP-B-4-11608, discloses a direct cooling apparatus to cool the steel strip just after delivering from the roll mill. But this apparatus is not available for installing a detecting sensor for steel strip temperature and sheet thickness during rolling step as significant items in quality control of the steel strip.

This requires an air cooling space after the final finishing mill to install a thermometer or a thickness gage at the space.

However, cooling is difficult to start at the steel strip top end, because it vibrates up and down at free state.

While, JP-U-57-82407 discloses a technique giving a travel driving force to the steel strip by providing another driving roll which can rotates upwards to the table roll.

This technique, however, should arrange an upper driving roll as densely as the lower table roll. If not, the steel strip top end might be crashed into the roll clearance or be broken at the half way the steel strip top end once crashed into the upper or lower rolls generates up and down vibration due to reaction force to disturb stable passage, especially for thinner strip. Rolls if arranged densely at both upper and lower sides will disturb strong cooling because the cooling nozzle area is narrowed.

SUMMARY OF THE INVENTION

It is an object of the first invention to provide an apparatus and a method for cooling a hot rolled steel strip wherein the steel strip having no tension is cooled stably and strongly at a runout table arranged between a finishing mill and a coiler.

It is an object of the second invention to provide an apparatus and a method for cooling a hot rolled steel strip wherein cooling water is removed rapidly from the surface of the steel strip during cooling the steel strip, to move the steel strip smoothly and to produce the hot rolled steel strip without any defect.

It is an object of the third invention to provide an apparatus and a method for cooling a hot rolled steel strip wherein a top end of a steel strip moves smoothly from a final finishing mill to a coiler to cool the steel strip rapidly and to ensure a cooling efficiency.

It is an object of the fourth invention to provide a method for manufacturing a hot rolled steel strip with a cooling step of cooling a hot rolled steel strip. The cooling step uses either of the cooling apparatus and cooling methods according to the first through third inventions.

The first invention is to install a lower surface cooling box between transfer rolls on the runout transferring the steel strip, and to provide an upper surface cooling box movable vertically to corresponding positions to the lower surface cooling box for symmetrical water ejection to the steel strip in upper and lower directions, and to pass the steel strip to the center of a confluence of the cooling water, and to provide a water breaking roll rotating in synchronization with the peripheral speed of the transfer roll, and to lower rotating the water breaking roll concurrently with passing the cooling apparatus, and to lower the upper surface cooling box at the same time to cool the steel strip.

In addition, the first invention provides the cooling apparatus of the hot rolled steel strip to pinch the upper and lower surfaces at the top by the water breaking roll and the transfer roll concurrently with passage of the top end of the steel strip and concurrently to eject the cooling water at the following conditions from upper and lower surfaces of the steel strip and its cooling method.

Use of the cooling apparatus and cooling method enables to rapidly cool symmetrically the upper and lower surfaces and to manufacture stably the hot rolled steel strip with fine grain size by this online cooling.

This prevents excessive cooling without cooling water remaining on the steel strip at the downstream of the cooling apparatus, stabilizes the cooling stop temperature in both width and longitudinal directions of the steel strip, equalizes completely cooling conditions at both upper and lower surfaces, eliminates to occur bending during cooling and residual stress after cooling, and manufactures stably the uniform hot rolled steel strip with a constant grain size in the longitudinal and width directions.

This also enables to eject the cooling water at the same cooling condition as the center of the steel strip under tension even under non-tension before coiling the steel strip top by the coiler, resulting in uniform material property in upper and lower surfaces as well as the longitudinal direction to raise a product yield rate to stabilized the quality of the steel strip.

The second invention is intended to solve these problems to arrange a water breaking means just above the transfer roll at an entrance, exit, or entrance and exit sides at the cooling apparatus in the runout transferring the steel strip on plural rotating transfer rolls and in parallel with the transfer roll to install the water breaking means at the position where the steel strip and clearance exist.

The water breaking means can freely elevate up and down to employ a water breaking roll as a water breaking means with a preferable distance 1 to 10 mm between the water breaking roll and the steel strip to rotate the water breaking roll at the peripheral speed of the water breaking roll roughly to coincide with the transfer speed of the steel strip, and to install at least one or more fluid ejection nozzles at an opposite side of the cooling apparatus to discharge rapidly the cooling water flown from the clearance between the water breaking roll and the steel strip away from the steel strip.

The invention provides a structure not to damage or disturb passage of the product by evacuating the roll upwards at passing the steel strip top. The water breaking roll effectively discharges the cooling water from the upper surface of the steel strip on the runout after rolling.

As a water breaking means, the water breaking roll is the best choice, but another water breaking means with a baffle installed at a proper angle can also be acceptable.

An upper and lower cooling boxes comprising the cooling apparatus are arranged at a position facing each other across the steel strip to be transferred to eject the cooling water to the hot rolled steel strip. The upper cooling box elevated freely to the transfer roll is equipped with the water breaking roll at least at its exit side and at a position facing to the transfer roll.

A distance between a nozzle outlet discharging cooling water as a laminar flow and the hot rolled steel strip is ranged to 30 to 100 mm.

Use of above cooling apparatus and the cooling method enables to effectively discharge the cooling water from upper surface of the steel strip to manufacture stably the hot rolled steel strip with a fine grain size.

The third invention is intended to solve these problems to provide an accompanying roll continuously from the finishing mill side with a clearance over sheet thickness of the steel strip just above the transfer roll in the runout transferring the steel strip on the transfer means comprising the plural rotating transfer rolls behind the final finishing mill to rotate the accompanying roll nearly at the same peripheral speed as the transfer roll to push out the steel strip backwards by rotating at higher speed than the transfer speed of the steel strip.

In addition, a plate passing guide is provided between transfer rolls and between accompanying rolls to pass the steel strip between the guides. A cooling nozzle is installed at an opposite side of the steel strip to the guide to eject the cooling water from upper and lower sides of the steel strip for cooling. Such cooling apparatus is installed behind the final finishing roll and in the runout in front of the coiler.

Furthermore, at least one or more pinch roll pairs to pinch steel strip at the position during plate passage or just after the cooling apparatus to reach the steel strip top end to the pinch rolls pair giving tension to the steel strip at an upstream side to stabilize the plate passing. A rotating contact of the pinch roll pair is released sequentially upon reaching the downstream pinch roll pair or coiler.

Use of the cooling apparatus and cooling method of the hot rolled steel strip can stably and rapidly cool the steel strip just after the roll mill. In particular, the same cooling condition as the center of the steel strip under tension is available even under non-tension before reaching coiler, resulting in completely equal cooling condition to upper and lower surfaces at the steel strip top.

Restraining occurrence of bend or residual stress after cooling can produce uniform grain size in longitudinal and width directions. This results in uniform product with a high yield rate to supply the hot rolled steel strip with stabilized quality.

This cooling apparatus and cooling method ensures a constant path line of the steel strip using a fluid pressure to prevent defect from occurring without any folding of the steel strip or deforming to an accordion like shape.

The fourth invention uses either of a cooling apparatus or a cooling method of the hot rolled steel strip according to the first through the third inventions to provide the cooling step for hot rolled steel strip cooling and to manufacture the hot rolled steel strip.

This results in an effective discharging the cooling water from upper surface of the steel strip not only to prevent excessive cooling to eliminate bending during cooling and residual stress after cooling but also to manufacture stably the hot rolled steel strip with uniform grain size in longitudinal and width directions.

EMBODIMENT FOR CARRYING OUT THE INVENTION

The first invention is described below referring to drawings.

Figure 1:
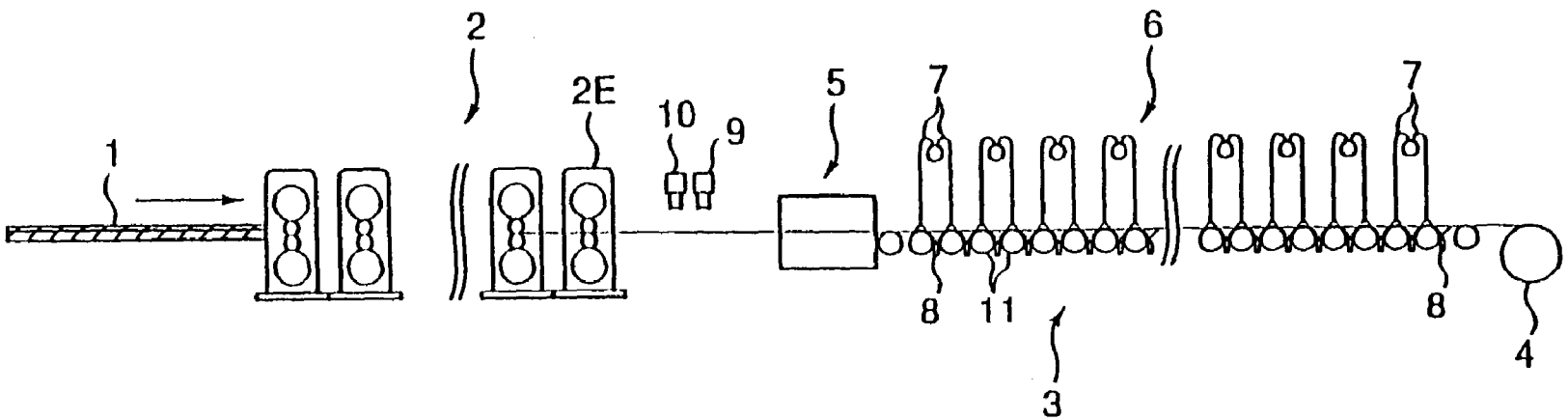
FIG. 1 is a schematic diagram of a rolling mill showing the first embodiment of the first invention.
Figure 2:
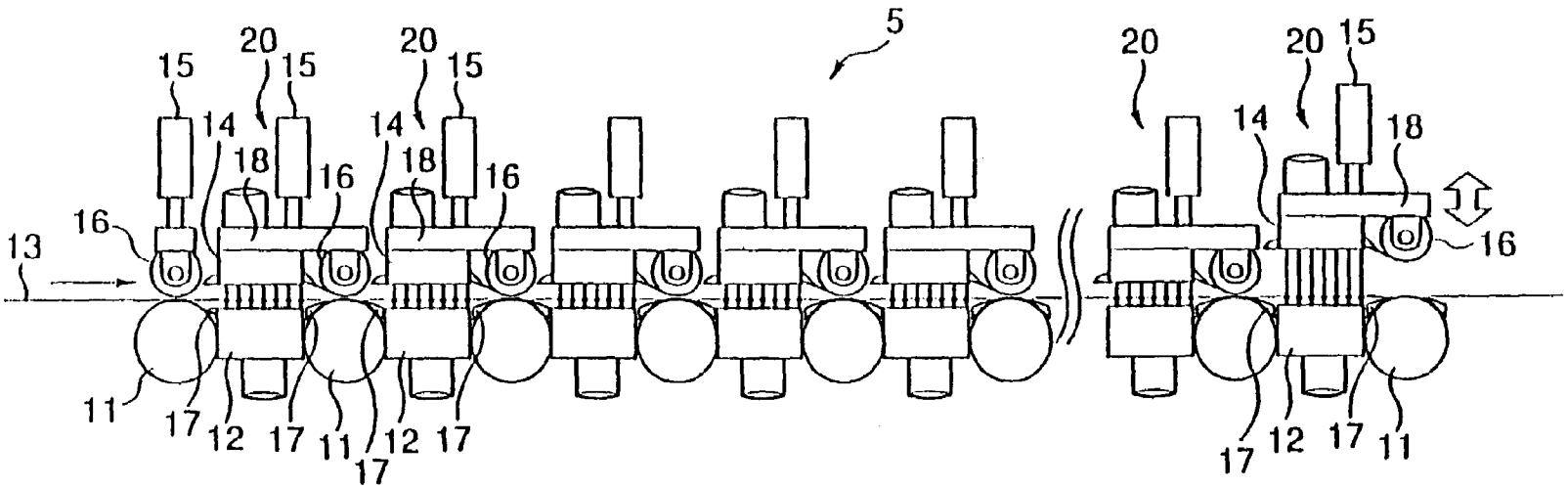
FIG. 2 is a schematic diagram of a cooling apparatus for the first embodiment.

FIG. 1 shows schematically a manufacturing equipment of a hot rolled steel strip of the first embodiment and FIG. 2 indicates schematically a first cooling apparatus.

A rough bar 1 rolled by a roughing mill is transferred on transfer rolls of a transfer means and is guided to a runout table 3 behind a final finishing mill 2E after rolling sequentially to the specified thickness by seven stands of continuous finishing mill 2. Most areas of the runout table 3 are equipped with a cooling apparatus (cooling means) where a steel strip is cooled and rolled up by a coiler to form a hot rolled coil.

The narrower a mutual distance between transfer rolls 11 comprising the runout table the more stable a plate passage ability is, but if too narrowed no space is available to arrange the cooling apparatus to extend a cooling length to deteriorate a cooling efficiency. Therefore, the mutual distance between the transfer rolls 11 is desirable to be from a roll diameter plus 100 mm to about three times of the roll diameter.

As the above cooling apparatus, a first cooling apparatus 5 is provided at the upstream of the runout table 3 and a second cooling apparatus 6 is installed at the downstream of the table.

Above the first cooling apparatus 5 is located at a position ranging from about 10 m to 25 m behind the final finishing mill 2E comprises components described below.

Above the second cooling apparatus 6 is located at a position of about 70 m downstream of the first cooling apparatus 5 indicated before, comprising plural circular tube laminar nozzles 7 arranged at the specified pitch upstream of the runout table 3 and plural commercial spray nozzles 8 installed between the transfer rolls 11 comprising the transfer means of the steel strip downstream side.

In addition, there are a steel strip thermometer 9 and a gamma ray plate thickness gage 10 arranged between the final finishing mill 2E and the cooling apparatus 5.

The first and second cooling apparatus 5 and 6 arranged along with the turnout table 3 are used for steel types necessary strong cooling. The first cooling apparatus 5 is provided for rapid cooling treatment just after rolling and the second cooling apparatus 6, behind the system 5, for rolling up at the specified rewinding temperature is equipped for cooling treatment.

For steel types not requiring strong cooling, the first cooling apparatus 5 is stopped to operate rapid cooling action and only the second cooling apparatus 6 for conventional slow cooling is applied for cooling step, resulting in sorting of the steel strip material manufactured.

As shown in FIG. 2, the transfer rolls 11 comprising a transfer means of 350 mm in diameter are arranged at about 800 mm pitch in the longitudinal direction within an arranging area of the first cooling apparatus 5 and these transfer rolls 11 are located at the lower surface of the steel strip.

Lower surface cooling boxes 12 of about 430 mm in length and about 1860 mm in width are provided between mutual transfer rolls 11. A total of 12 units lower surface cooling boxes 12 are arranged in the longitudinal direction of the system to act as the first cooling apparatus 5 for about 5160 mm in length. A distance between the lower surface cooling box and the steel strip 13 to be cooled is specified to be about 50 mm.

While upper surface cooling boxes 14, as an upper surface cooling means, are arranged in the same number as, and at the corresponding positions to, and with the equal length and width specified to the lower surface cooling boxes 12 at the upper surface of the steel strip 13 in the first cooling apparatus 5.

The upper cooling box 14 is supported by a frame 18, and a water breaking roll 16 is provided as a water breaking means at the upper cooling surface box 14 side of the frame. The water breaking roll 16, as described below, is to remove the cooling water remaining on the upper surface of the steel strip as a causing factor of an excessive cooling of the steel strip upon cooling the steel strip to be an effective means for unified material property.

The frame 18 is connected to an air cylinder 15, which comprises an upper cooling block 20.

The air cylinder 15 adjusts the specified height of the upper surface cooling box by equalizing distance between the upper surface of the steel strip and an edge of the upper cooling box 14 with distance between and edge of the lower surface cooling box 12 and the lower surface of the steel strip 13.

During non-cooling mode not acting the first cooling apparatus 5, the air cylinder operates in timing with passage of the steel strip top to elevate the upper cooling box 14 and the water breaking roll 16 to the position about 500 mm above the line to evacuate them from the steel strip 13. During normal cooling for the steel strip 13, distance between the upper and lower surface cooling boxes 14 and 12 is specified to be plate thickness of the steel strip plus 100 mm.

The water breaking roll 16 is a rotating roll of 200 mm in diameter at the position corresponding to the transfer rolls 11. Rotation is controlled to be equalized with the peripheral speed of the transfer roll 11 at the lower side.

This embodiment specifies the upper cooling box 14 to move in concurrent with the water breaking roll 16, but it is desirable for better cooling response to start lowering the water breaking roll 16 and the upper cooling box 14 starting from the upper cooling box 20 at the upstream side working with the passage of the steel strip top 13. For the purpose of this, the upper cooling box 14 may be elevated independently with the water breaking roll 16.

Edges facing the steel strip 13 of the upper and lower cooling boxes 14 and 12 are made of steel plate of 1.6 mm in thickness. The steel plate is equipped with nozzle holes of the specified diameter at a constant staggered pitch from which the cooling water is supplied as a column state laminar flow. The upper and lower cooling boxes 14 and 12 are positioned to be symmetrical up and down at least at the collision point of the upstream side.

In addition, for stabilized plate passage, a so-called grating state guide 17 is provided between the lower cooling box 12 and the transfer roll 11 for the lower surface of the steel strip 13, and between the upper cooling surface boxes 14 for the upper surface of the steel strip 13. In particular, the steel strip top 13 is designed to prevent from sticking at each clearance.

Any surface of the grating state guide 17 potentially contacting the steel strip 13 is covered with an organic resin film not to generate flaw at the steel strip even if contacting the steel strip. The organic resin is desirable to be heat resistant material softer than the steel strip not to cause flaw at the steel strip even when the temperature rises by radiation heat passing the steel strip at high temperature.

In the case where the cooling water is not ejected from the first cooling apparatus 5, it is effective to eject the cooling water to the extent not to reach the steel strip to prevent this surface from exposing at high temperature. Preferably, the water breaking roll 16 is coated at the surface with similar resin material to prevent flaw from occurring.

Next, the cooling step for the hot rolled steel strip 13 is described below.

An upper cooling block 20 located at the corresponding position is actuated to lower the upper surface cooling box 12 and the water breaking roll 16 concurrently with the top end of the hot rolled steel strip delivered from the final finishing mill 2E passing at the first cooling apparatus 5. As a result, the cooling water is ejected from the lowered upper surface cooling box 14 and the lower cooling box located at corresponding position.

The step is specified because the cooling water if ejected from the upper and lower cooling boxes 14 and 12 before passing the steel strip top end might damage the plate passage ability at the top area.

Once passing the steel strip top end, the path line of the steel strip 13 is maintained constant by the pressure balance of the cooling water ejected from the upper surface cooling box 14 and from the lower cooling box 12. Therefore, plate passing ability of the steel strip 13 is stabilized even under non-tension to the steel strip 13 for uniform strong cooling to the steel strip 13.

The top end of the steel strip 13 enters the first cooling apparatus 5 to eject the cooling water from the upper and lower cooling boxes 14 and 12 corresponding to the top end. In this case, the upper cooling box 14 may be fixed at the elevated position the upper cooling box 14 and the water breaking roll 16 if lowered after stabilizing the plate passing ability will not affect the plate passing ability of the steel strip which was already passed or will be passed.

During lowering of the water breaking roll 16, the peripheral speed of the transfer roll 11 and the water breaking roll 16 is desirable to be faster than that of the rolling speed because of preventing sag of the steel strip from the roll mill to the cooling apparatus for stable plate passage.

After the water breaking roll is completely lowered, the water breaking roll 16 and the transfer roll 11 if controlled to rotate for ensuring a constant tension to the steel strip 13 pinched by these rolls is effective to have a function for stable plate passage of the hot rolled steel strip to prevent flaw form occurring due to slip between the water breaking roll 16 and the steel strip 13.

Timing to pinch the steel strip 13 and relation to the cooling condition for the upper and lower surfaces of the steel strip are specified as follows.

The first invention comprises a pinching step of upper and lower surfaces at the top end of the steel strip 13 using the water breaking roll 16 and the transfer roll 11 in concurrence with passage at the top end of the steel strip 13, and a cooling step of the steel strip by ejecting the cooling water at the specified condition from the upper and lower surfaces with the pinching step.

The first invention also comprises a pinching step of upper and lower surfaces at the top end using the water breaking roll 16 and the transfer roll 11 in concurrence with passage at the top end of the steel strip 13, and a cooling step of the steel strip by ejecting the cooling water to equalize the fluid pressure to the upper surface and one to the lower surface with the pinching step.

Or the first invention comprises a pinching step of the steel strip at the same peripheral speed of the water breaking roll 16 as that of the transfer roll 11 to the lower surface by contacting the steel strip top 13 to the water breaking roll 16 concurrently lowered, and a cooling step to the steel strip by ejecting the cooling water to equalize fluid to the upper surface of the steel strip and one to the lower surface.

A distance from the upper and lower cooling boxes 14 and 12 comprising the first cooling apparatus 5 to the steel strip 13 is specified to be 50 mm due to the following reasons.

The distance between the cooling means and the steel strip if extended will weaken the cooling water force due to absorption by the fluid (cooling water). On the other hand, the distance between the cooling means and the steel strip if narrowed will energize the cooling water force so that the steel strip passes a balancing position of the surface pressure from the cooling water ejected from the upper surface and that from the lower surface, resulting in a centering effect to correct vibration and deviated travel.

In general, a fluid pressure of 0.01 to 0.2 kg/cm$^2$G if available to the steel strip can realize the centering effect. In this case, a laminar state cooling water reaches the steel strip so that the cooling means cannot be separated from the steel strip for better cooling.

The distance is desirable to be 30 to 100 mm for 2 to 5 mm in a laminar flow nozzle diameter. For example, the cooling water force will be weakened at the diameter over 100 mm not applicable for strong cooling. On the contrary, at the diameter close to 30 mm the cooling water misses the volume to flow, resulting in unavailable for the proper water flow. This makes a rapid cooling impossible or causes cooling imbalance with cooling water flow quite different from at the center and edge areas.

Above conditions are different depending on constitution of the cooling means, so ejecting conditions of the cooling water for uniform cooling effect over the width of the steel strip can be determined by regulating a force acting to the steel strip to around 0.01 to 0.2 kg/cm$^2$G.

For further stabilized plate passing ability at the inlet side, another water breaking roll 16 which can be elevated and the same as that provided at the cooling apparatus side may be installed at the inlet side of the first cooling apparatus 5. The transfer speed of the steel strip is so high that the water breaking roll 16 at the inlet side more effectively contributes to the plate passing ability instead of prevention effect to the water leakage.

In this apparatus, the steel strip of 1,500 mm in the finished width and of 3 mm in the finished plate thickness is accelerated at a sledding speed of 650 mpm and an acceleration rate of 9 mpm/s to 1,200 mpm at the maximum and then is deaccelerated at 650 mpm passing through the bottom end of the steel strip.

At acceleration of the steel strip, the water flow of the first cooling apparatus 5 and the second cooling apparatus 6 is increased to control the coiling temperature constant. In this case, the steel strip can stably be passed at the cooling apparatus 5 and 6 from its top end to the bottom end for specified cooling. This results in no leakage of cooling water before and after the cooling apparatus 5 and 6 without occurring any flaw.

As a result, the hot rolled steel strip with a fine and uniform grain size can be manufactured stably. Variation of the rewinding temperature was within 1520 C. from the top end to the bottom end, resulting in the stable cooling. Measured readings at thermometer estimate that the cooling speed of the steel strip 13 was available for the rapid cooling of 500° C./s at the first cooling apparatus 5.

(Comparison Example)

A comparison example describes that the roll mill which is the same as the first embodiment uses to roll the hot rolled steel strip of 3 mm in the finished thickness and then to cool at the maximum flow rate by the second cooling apparatus 6 within the extent not to disturb the stable plate passage.

The steel strip of 3 mm in thickness is accelerated at the sledding speed of 650 mpm and at the acceleration of 9 mpm/s to 1,200 mpm to the maximum and then is deaccelerated at 650 mpm to pass through the steel strip. In this case, only the second cooling apparatus 6 was operated for rapid cooling at the maximum flow rate under the stable plate passage.

The cooling speed was 70° C./s with a large variation in the grain size at upper and lower surfaces of the steel strip from the top end to the bottom end. This results in cutting 70 m at the top end and bottom end of the steel strip because it does not meet the material requirement to reduce the yield rate.

The second invention is described below referring to drawings.

Figure 3:
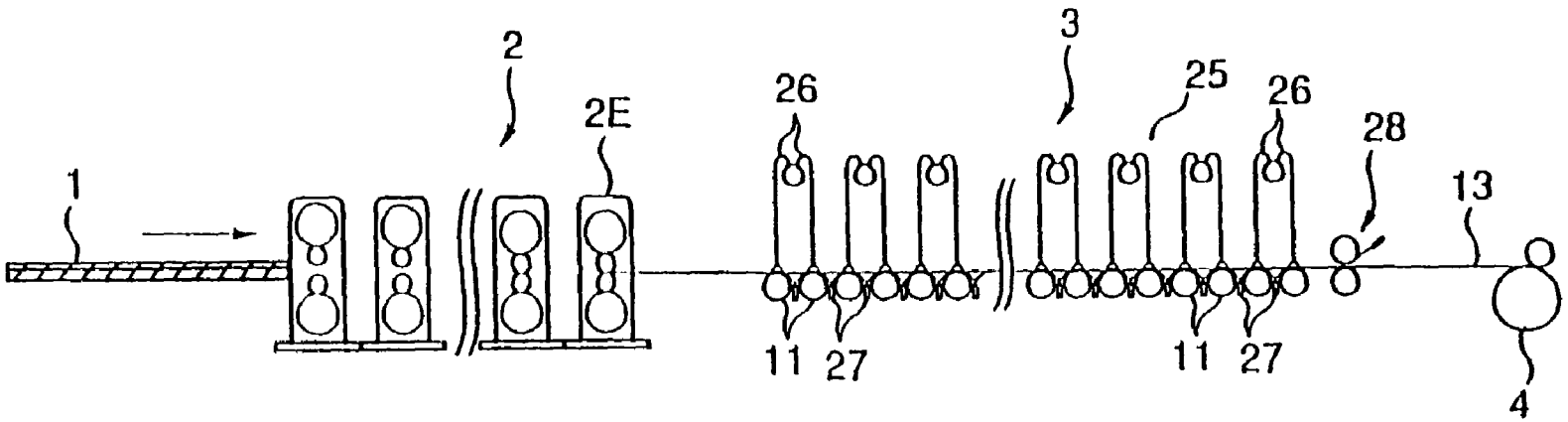
FIG. 3 is a schematic diagram of the rolling mill showing the second embodiment of the second invention.

FIG. 3 shows a schematic drawing of a manufacturing equipment of a hot rolled steel strip at the second embodiment.

A rough bar 1 rolled at a roughing mill is transferred on the transfer rolls to roll to the specified thickness by passing seven units of continuous finishing mill 2 and finally is guided to a runout table 3 behind the final finishing mill 2E. The runout table is 80 m in an entire length typically comprising a cooling apparatus at which the plate is cooled and rolled up by a coiler 4 to form the hot rolled coil.

A cooling apparatus (cooling means) 25 provided at the runout table 3 comprises plural circular laminar nozzles 26 arranged at the specified pitch at the upper surface of the runout table 3 and plural spray nozzles 27 provided between the transfer rolls 11 comprising the transfer means of the steel strip at the lower side. A water breaking device (water breaking means) described later is arranged at the outlet of the cooling apparatus 25.

Figure 4:
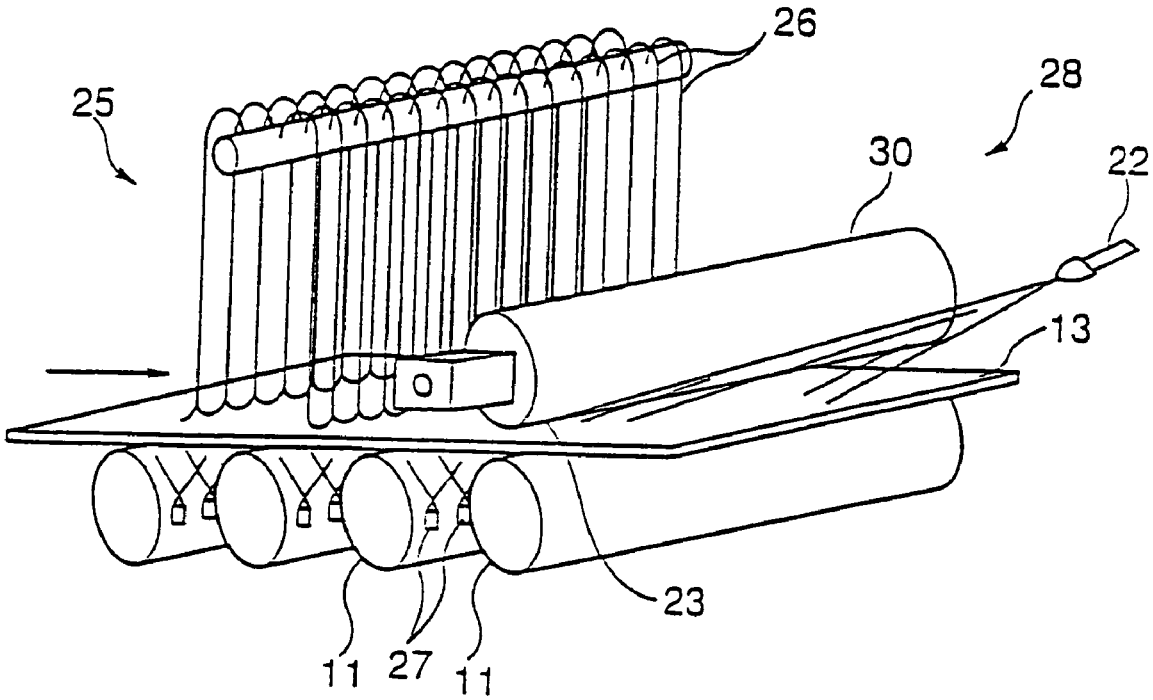
FIG. 4 is a schematic diagram of the cooling apparatus and water breaking apparatus of the second embodiment.

A water breaking device 28 above and its peripherals are arranged as shown in FIG. 4. At the runout table 3, the transfer rolls 11 of 350 mm in diameter are arranged at about 400 mm pitch in the longitudinal direction. The transfer rolls 11 are positioned at the lower side of the steel strip 13.

The spray nozzles 27 above ejecting the cooling water between the transfer rolls 11 are arranged at 100 mm pitch in the width direction. The spray nozzles may be supplied from commercial products. On the other hand, at the upper side of the steel strip, circular laminar nozzles 26 are arranged at 100 mm pitch in the width direction on the transfer rolls 11 at the position of 1,500 mm in height from the steel strip path line making a line on roll axis.

As the water breaking device above, a water breaking roll 30 of 250 mm in diameter is arranged in parallel with the transfer roll just above the last transfer roll 11 of the cooling apparatus 25. The water breaking roll 30 can elevate up and down for regulating its height freely. At one side of the water breaking roll 30, a driving motor 23 is mounted to rotate the roll.

A clearance (distance) between the water breaking roll 30 and the steel strip 13 is effective to eliminate adjustment of the load to the steel strip for steady water breaking. The narrower the clearance is the higher the water breaking efficiency.

An practical equipment, however, vibrates the steel strip along with transfer movement, so that the clearance is desirable to be less than 30 mm and is preferably set to 1 to 10 mm.

The clearance if less than 1 to 10 mm enables to improve the water breaking effect but might generate vibration due to contact of the water breaking roll 30 and the steel strip 13 potentially to damage the plate passing ability. The clearance if set larger than 1 to 10 mm can avoid the contact but deteriorates the water breaking effect. This means that an increase in leaked water requires to raise the water flow to blow the leaked water as well as the water pressure. More preferably, the clearance is set to 3 to 5 mm.

To prevent the steel strip from damaging at contacting the water breaking roll 30, the water breaking roll 30 is regulated by the driving motor 23 above to rotate at the peripheral speed coincident to the transfer speed of the steel strip 13.

In addition, a water breaking spray nozzle 22 as a fluid spray means is provided after the water breaking roll 30 to eject high pressure water in the width direction from one side to another side at the upper surface of the steel strip 13.

The water breaking device 28 in this constitution operates as follows.

Concurrently with passing of the steel strip 13 after rolled to the cooling apparatus 25, the clearance is set by lowering the water breaking roll 30 to the specified position to maintain distance between the water breaking roll 30 and the steel strip 13 to 5 mm. In this case, the water breaking roll 30 is rotated at the same peripheral speed as the transfer speed of the steel strip 13 to prevent flaw from occurring due to contact of the water breaking roll 30 and the steel strip 13. In addition, the water breaking spray nozzle 22 after the water breaking roll 30 ejects high pressure water (about 2 MPa) in the slant direction to blow the cooling water leaked from clearance between the steel strip 13 and the water breaking roll 30.

Or/additionally, the water breaking roll 30 is elevated in synchronization with passage of the steel strip end.

The apparatus above uses to pass the steel strip of 1230 mm in finished width and 3 mm in finished thickness at a speed of 600 mpm to cool. In this case, a part of the cooling water ejected at the steel strip 13 in the cooling apparatus 25 tends to flow out from the cooling apparatus 25 backward along with moving the steel strip, but is blocked by the water breaking roll 30 to flow down at the both sides of the steel strip.

Nonetheless the cooling water leaked from the clearance between the water breaking roll 30 and the steel strip 13 is blown away from one side of the steel strip by the high pressure spray water ejected from the water breaking spray nozzle 22 just after the water breaking roll 30.

This results in little cooling water remaining on the steel strip after the water breaking roll 30 not to cause flaw at the steel strip due to the water breaking roll. Excessive cooling by the remaining water is eliminated to make temperature after cooling at each part of the steel strip constant. Detailed survey at material in the longitudinal direction of the steel strip shows that the steel strip at the uniform grain size is obtained stably.

Figure 5:
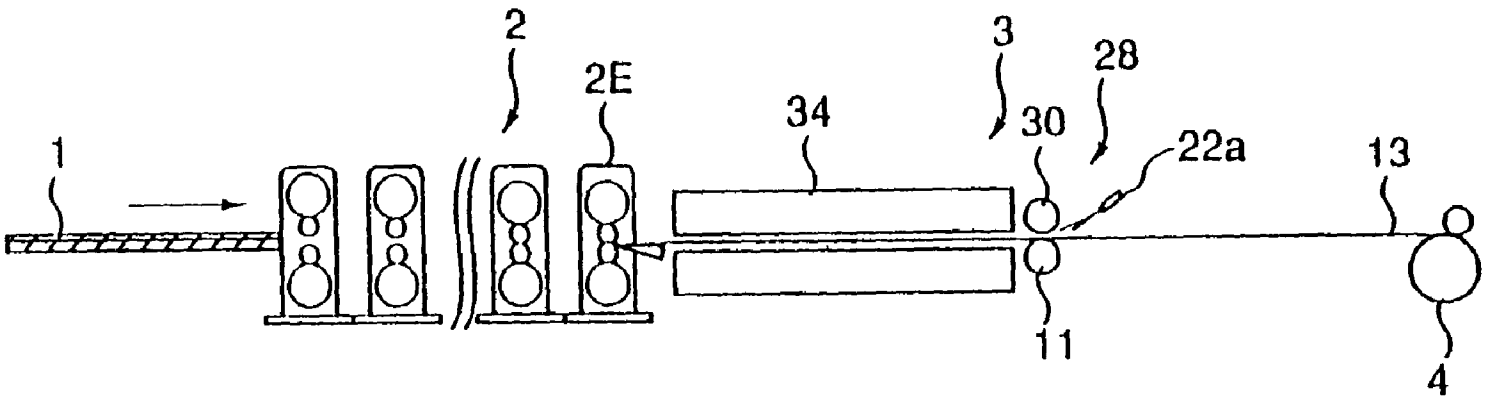
FIG. 5 is a schematic diagram of the roll milling showing the third embodiment figure of the second invention.

FIG. 5 shows a schematic drawing of a manufacturing equipment of a hot rolled steel strip at the third embodiment. A rough bar 1 rolled at a roughing mill is transferred on transfer rolls to roll to the specified thickness by passing seven units of continuous finishing mill 2 and finally is guided to a runout table 3 installed extending to 80 m behind a final finishing mill 2E. Most of the runout table comprises a cooling apparatus cools at which the steel strip 13 is cooled and rewound by the coiler 4 to form the hot rolled coil.

The runout table 3 is equipped with a proximity cooling apparatus 34 described later of about 15 m in length and after with a water breaking device 28A described later is provided.

Figure 6:
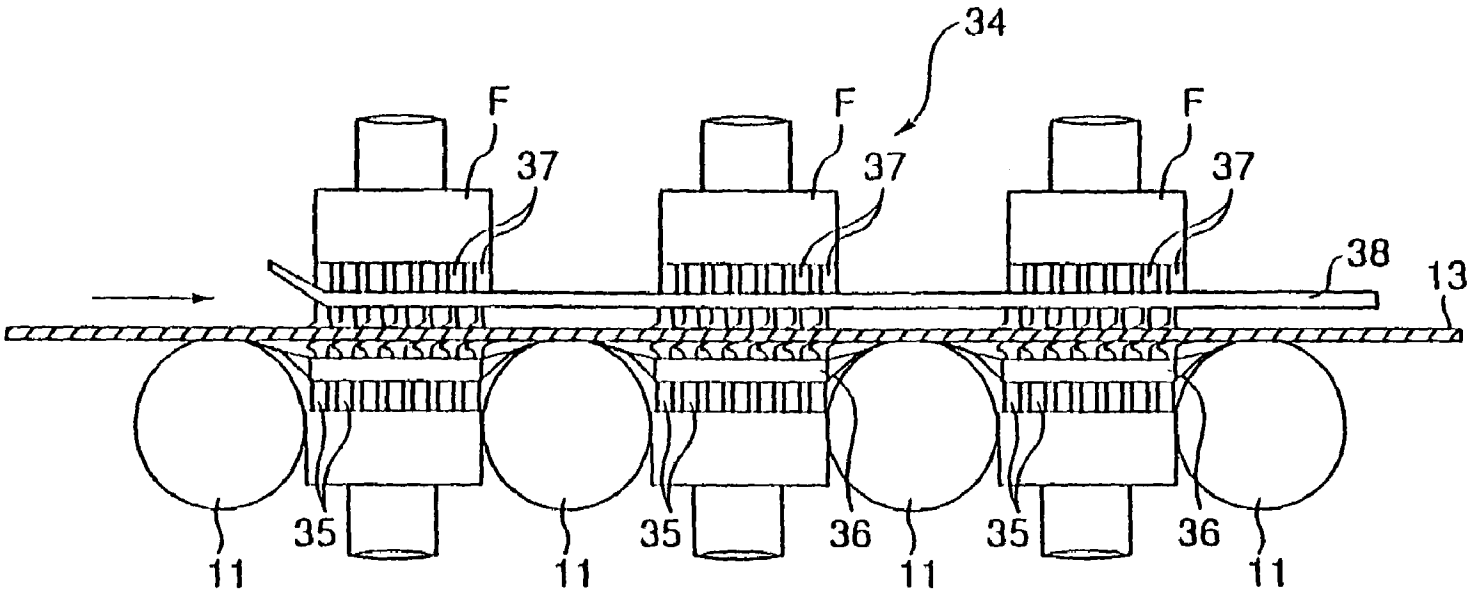
FIG. 6 is a schematic diagram of the cooling apparatus of the third embodiment.

The cooling apparatus 34 above comprises as shown in FIG. 6. The drawing shows the rotating transfer rolls 11 of 350 mm in diameter are arranged at about 800 mm pitch in the longitudinal direction at the lower side. Between the transfer rolls 11, the lower cooling nozzles 35 are provided for about 1860 mm in the width direction. The lower cooling nozzles 35 are installed at even interval in the width direction to the guides 36 located at a grating state.

On the other hand, upper cooling nozzles 37 are arranged at the position corresponding to The lower cooling nozzles 35 at the upper side. The upper cooling nozzles 37 are effective to prevent the steel strip 13 from contacting the guide 38 located at a grating state as like. A frame F supporting the upper cooling nozzle is moving up and down by a driving mechanism not shown in FIG. 6.

The upper cooling nozzle 37 and the lower cooling nozzle 35 employ a circular laminar nozzle to rapidly cool the steel strip 13. The nozzles, however, are not limited to this example, but may be combined with another type vertically such as a flat laminar nozzle and a spray nozzle. In any case, an ejection condition of the cooling water was specified to be 3,500 L/m2·min for both upper and lower surfaces.

Figure 7:
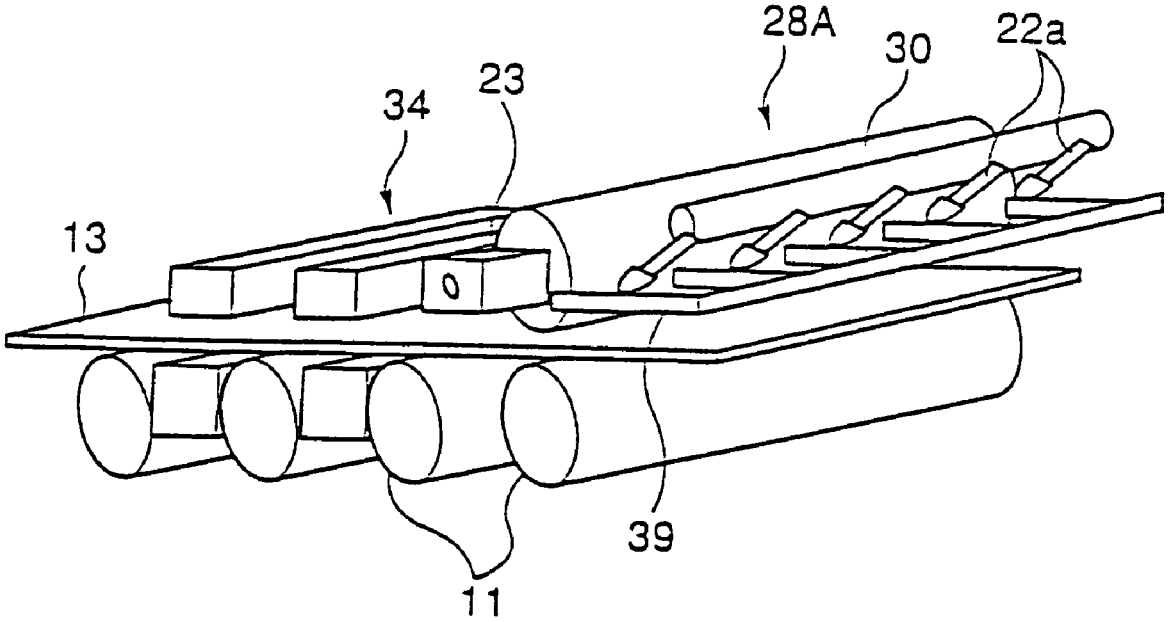
FIG. 7 is a schematic diagram of the cooling apparatus and water breaking apparatus of the third embodiment.

As shown in FIG. 7, a water breaking roll 30 of 250 mm in diameter is arranged as a device 28A just above the last transfer roll 11 of the cooling apparatus 25 in parallel with the transfer roll. The water breaking roll 30 can move up and down to change its height freely.

For steady water breaking to eliminate load adjustment, the clearance (distance) between the water breaking roll 30 and the steel strip 13 is specified to 1 to 10 mm for example to 5 mm during down movement.

A lowering timing is set concurrently with a moment when the top of he steel strip 13 passes the cooling apparatus 34 or/in addition to raise the water breaking roll 30 by synchronizing passage of the steel strip 13 end.

A peripheral speed of the water breaking roll 30 is determined to be the same as the transfer speed of the steel strip 13 to prevent flaw at the steel strip from occurring even when the steel strip 13 contacts the water breaking roll 30. Plural water breaking spray nozzles 22*a* as a fluid ejector ejecting high pressure water to the position just after the water breaking roll 30 are provided. Typically, five sets of these water breaking spray nozzles 22*a* are installed at a slant each other at a 300 mm interval.

High pressure water (about 1.5 MPa) when ejected at a time from plural water breaking spray nozzles 22*a* feed breaking water from one end to another end of the steel strip 13 to blow cooling water flown from the clearance between the water breaking roll 30 and the steel strip 13 to remove at one edge in the width direction of the steel strip 13.

The water breaking spray nozzle 22*a* proved in the width direction of the steel strip 13 can ensure steady water breaking even when the width of the steel strip is wide, or even when the water pressure of the spray nozzle is reduced.

To prevent collision of the steel strip top 13 and the water breaking spray nozzles 22*a*, A guide 39 is provided close to the water breaking spray nozzle 22*a*.

The equipment above transferred at a speed of 600 mpm to cool the steel strip of 1,800 mm in finished width and of 3 mm in finished thickness. The water breaking roll 30 is lowered concurrently with passage of the cooling apparatus 34 to adjust the clearance to the steel strip 13. In addition, high pressure water is ejected as a time from plural water breaking spray nozzles 22*a*.

In a cooling apparatus 34, a part of the cooling water supplied at the steel strip 13 tends to flow out from the cooling apparatus to downstream along with movement of the steel strip, but most water is stopped by the water breaking roll 30 above to drop from side edges of the steel strip.

Even when the cooling water is leaked from the clearance between the water breaking roll 30 and the steel strip 11, high pressure spray water ejected from plural water breaking spray nozzles 22*a* blows it from one edge of the steel strip.

Behind the water breaking roll 30, no or little cooling water remains at the steel strip 13 not to cause flaws at the steel strip due to the water breaking roll 30. Excessive cooling due to remaining water is eliminated to ensure a constant temperature at each part of the steel strip after cooling. Detailed survey in the longitudinal direction shows that complete uniform grain size was stably formed at the steel strip.

Figure 8:
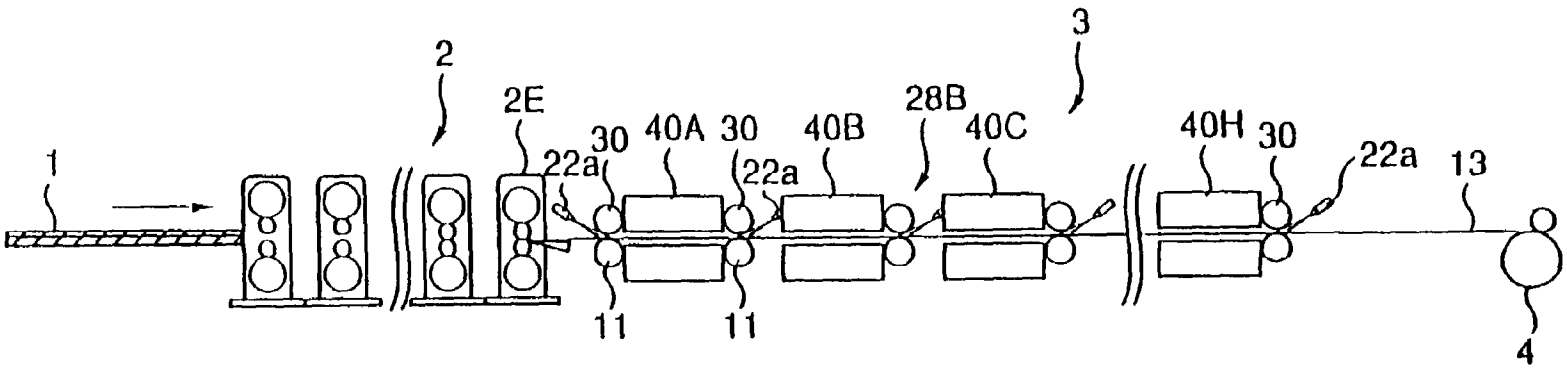
FIG. 8 is a schematic diagram of the rolling mill showing the fourth embodiment of the second invention.

FIG. 8 is a schematic drawing of the manufacturing equipment of a hot rolled steel strip at the forth embodiment. A rough bar 1 rolled at a roughing mill is transferred on the transfer rolls to roll to the specified thickness by passing seven units of continuous finishing mill 2 and finally is guided to a runout table 3 of 80 m in entire length after the final finishing mill 2E. The runout table typically comprises a cooling apparatus at which the plate is cooled and rolled up by the coiler 4 to form the hot rolled coil.

The runout table 3 is equipped with eight sets of proximity type cooling apparatus 40A through 40H of about 2 m in length. A total of nine water breaking rolls 30 of 250 mm in diameter, eight of which are arranged at the outlet side of each cooling apparatus 40A through 40H just above of and in parallel with the transfer rolls 11 and one is arranged at the inlet side of the first cooling apparatus 40A comprises the water breaking device 28B.

Each water breaking roll 30 is moved up and down to adjust its height freely. For steady water breaking to eliminate load adjustment, the clearance (distance) between the water breaking roll 30 and the steel strip 13 is specified to 1 to 10 mm for example to 5 mm during down movement.

A lowering timing is set concurrently with a moment when the top of the steel strip 13 passes the cooling apparatus 40A through 40H 34 or/in addition to raise the water breaking roll 30 by synchronizing passage of the steel strip 13 end.

A peripheral speed of the water breaking roll 30 is determined to be the same as the transfer speed of the steel strip. 13 to prevent flaw at the steel strip from occurring even when the steel strip 13 contacts the water breaking roll 30.

Plural water breaking spray nozzles 22*a* as a fluid ejector ejecting high pressure water to the position just after the water breaking roll 30 (or ahead of it for the first water breaking roll) are provided. Typically, five sets of these water breaking spray nozzles 22*a* are installed at a slant each other at a 300 mm interval.

High pressure water (about 2 MPa) when ejected at a time from plural water breaking spray nozzles 22*a* feed breaking water from one end to another end of the steel strip to blow cooling water flown from the clearance between the water breaking roll and the steel strip.

The equipment above transferred at a speed of 300 mpm to cool the steel strip of 1,200 mm in finished width and of 5 mm in finished thickness. In each cooling apparatus 40A through 40H, a part of the cooling water supplied at the steel strip 13 tends to flow out from the cooling apparatus to downstream along with movement of the steel strip, but most water is stopped by the water breaking roll 30 above to drop from side edges of the steel strip.

Even when the cooling water is leaked from the clearance between the water breaking roll 30 and the steel strip 13, high pressure spray water ejected from plural water breaking spray nozzles 22*a* blows it from one edge of the steel strip.

Behind the water breaking roll 30, no or little cooling water remains at the steel strip 13 not to cause flaws at the steel strip due to the water breaking roll 30. Excessive cooling due to remaining water is eliminated to ensure a constant temperature at each part of the steel strip after cooling. Detailed survey in the longitudinal direction shows that complete uniform grain size was stably formed at the steel strip.

In the embodiment, if the number of applied cooling apparatus is changed depending on the transfer speed of the steel strip 13 and its thickness, the water breaking roll and water breaking spray nozzles after the last downstream cooling apparatus can be available to effectively discharge the cooling water leaked from the cooling apparatus.

When the steel strip is transferred slowly at the cooling apparatus or when much cooling water is used, the cooling water might be also leaked at upstream side of the cooling apparatus. In this case, the water breaking roll 30 is also provided at the inlet side of the cooling apparatus in front of which the water breaking spray nozzle 22*a* is also arranged for breaking cooling water leaked from upstream side.

Figure 9A:
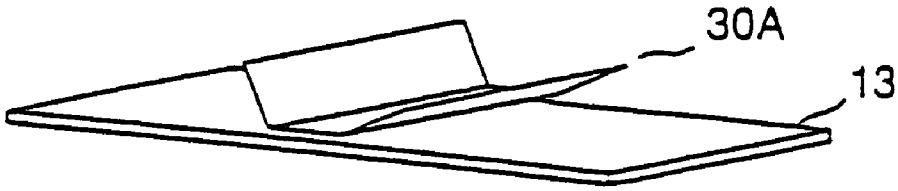
FIG. 9(*a*) through FIG. 9(*d*) are schematic perspective view of various types of water breaking apparatus of other working embodiments.

In the second and forth embodiments above, the water breaking roll 30 of 250 mm in diameter is installed as a water breaking device but not limited to this. For example, as shown in FIG. 9(A), a water breaking guide plate 30A made of a plate with a parallel section to the steel strip and folded at an angle at upstream and downstream sides of the steel strip is also acceptable.

Figure 9B:
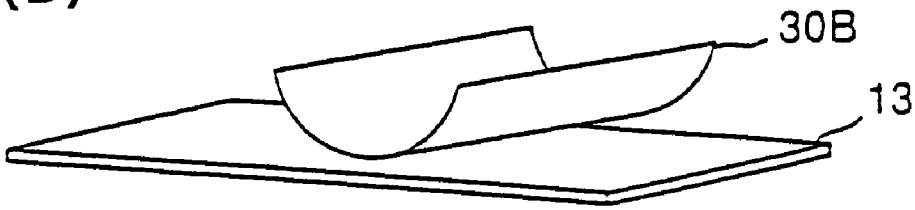

In addition, as shown in FIG. 9(B), a water breaking guide plate 30B made of a curved plate at the top of which contacts steel strip in parallel. The water breaking guide plates 30A and 30B are not rotated like the water breaking roll 30 so they are easy to make flaw at the steel strip when collided. Therefore, the guide plates 30A and 30B are made of softer material than the steel strip for example to choose synthetic resin materials.

Understandably, the steel strip 13 might collide with the water breaking roll 30 so the water breaking roll 30 may also be coated for example by organic resin materials.

Figure 9C:
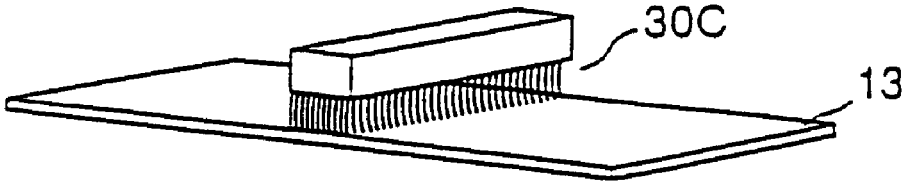
Figure 9D:
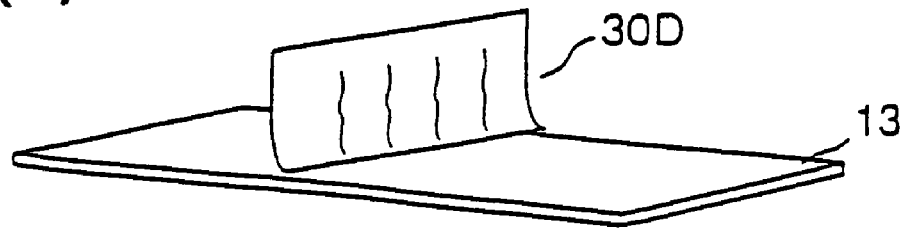

As shown in FIG. 9(C), a water breaking guide 30C with brushes is acceptable. As shown in FIG. 9(D), a curtain like water breaking guide 30D made of heat resistant material is acceptable. Furthermore, a curtain like water breaking guide formed by heat resistant material, not shown in drawing.

In any case, the water breaking device like the water breaking roll 30 described before is installed at the specified position and can be adjustable for its holding height. The clearance (distance) between each top area and the steel strip 13 is maintained to be 1 to 10 mm with the same condition as the water breaking roll 30.

In the second and forth embodiments above, the water breaking spray nozzles 22 and 22*a* are installed to eject water at a slant in the width direction of the steel strip after the water breaking roll 30, but limited to this. Another water breaking nozzle with different structures is also acceptable.

For example, possible examples contains a structure with plural spray nozzles arranged at the specified pitch along with the width direction to return the cooling water to the water breaking roll, a structure with spray nozzles at multiple stages in the width direction to eject water to blow the cooling water, as well as a combination of these water breaking structures.

The third invention is described referring to drawings below.

Figure 10A:
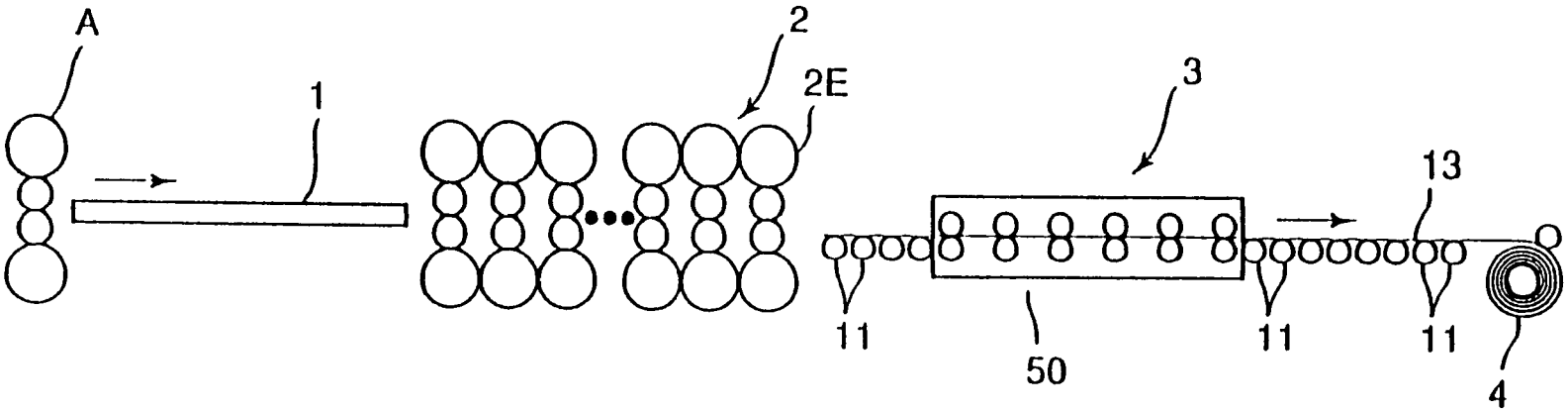
FIG. 10(*a*) and FIG. 10(B) are schematic diagram of the rolling mill and cooling apparatus showing the fifth embodiment of the third invention.
Figure 10B:
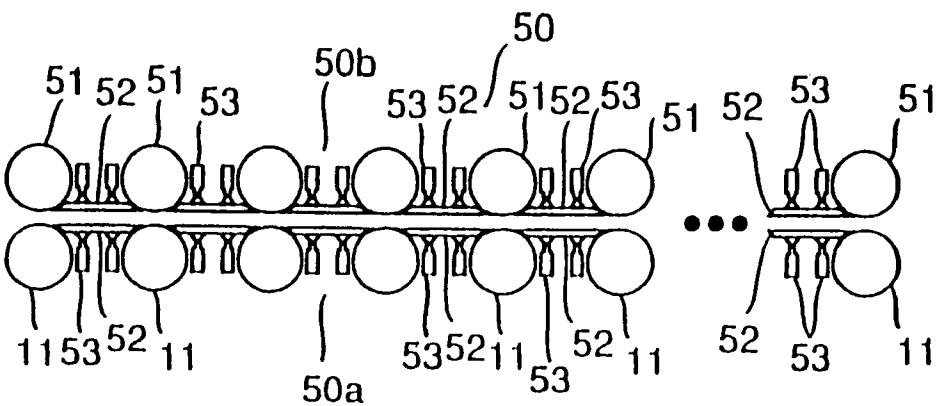

FIG. 10(A) is a schematic drawing of a manufacturing equipment of a hot rolled steel strip at the fifth embodiment and FIG. 10(B) shows a cooling apparatus of this manufacturing equipment (cooling means) in detail.

The embodiment shows a cooling condition for the hot rolled steel strip of 3 mm in thickness and is applied for the case where the cooling apparatus is located at a position far away from the last finishing mill and where no pinch roll pair exists at the strip side and the inlet and outlet sides.

This means that a rough bar 1 rolled at a roughing mill is transferred on the transfer rolls to roll to the specified thickness by passing seven units of continuous finishing mill 2 and finally is guided to a runout table 3 installed extending to 80 m after the final finishing mill 2E. The cooling apparatus 50 (cooling means) is arranged around at the center of the runout table 3 where a steel strip 13 is cooled and then rolled up by a coiler 6 to form the hot rolled coil.

Additionally, the transfer means at the runout table 3 above comprises plural transfer rolls 11 of 300 mm in diameter and is continuously arranged at a roll pitch of 350 mm.

The cooling apparatus above is arranged at the area 5 m through 20 m from the final finishing mill 2E at the runout table 3. At the inlet side of the cooling apparatus 50, some sensors not shown such as a thickness gage or a finishing thermometer are arranged.

The cooling apparatus 50 is equipped with plural transfer rolls 11 at 517 mm pitch. At each transfer roll 11, an accompanying roll 51 movable up and down is provided in parallel with the transfer roll 11.

The accompanying roll 51 is a means necessary to pass stably the steel strip top and plays a role as the water breaking roll's function described before. The accompanying roll 51 is rotated in the same direction and at the peripheral speed as the transfer roll 11.

Clearance between the accompanying roll 51 and its facing transfer roll 11 is determined to the thickness of the hot rolled steel strip 13 to be passed plus about 5 mm. For better plate passage, it is desirable less than the thickness of the steel strip 13 plus 30 mm.

To prevent damage of the steel strip due to contact of the transfer roll 11 and the accompanying roll 51 to the hot rolled steel strip 13, it is desirable to set the peripheral speed of the rolls 11 and 51 to be 0 to 20% faster than the transfer speed of the steel strip 13.

For better plate passing ability, it is further desirable to set the speed 5 to 20% faster than the transfer speed of the steel strip 13 to give a forward tension at the steel strip top 13 for stable passage of the steel strip top under no-tension.

The peripheral speed of the rolls may be changed to an almost equal peripheral speed to the transfer speed of the steel strip from the viewpoint of flaw protection. Almost equal peripheral speed in this case means a range including a mechanically unavoidable deviation in the speed, typically with an speed error of about ±5%.

A length of the cooling apparatus itself is about 15 m, at which therefore 30 sets of the accompanying roll 51 and transfer roll 11 are arranged each. The accompanying roll 51 can be moved up and down freely, and can be evacuated upward before the steel strip 13 is transferred.

The cooling apparatus 50 above comprises a cooling apparatus 50*a* located at under surface of the steel strip 13 transferred and a cooling apparatus 50*b* located at the upper surface.

At the lower surface cooling apparatus 50*a*, a flat plate passing guide 52 (plate passing guide) is provided between the transfer rolls 11 and plural spray nozzles 53 are installed under the guide. The plate passing guide 52 above is equipped with holes to pass the cooling water ejected from the spray nozzles 53.

At the upper surface cooling apparatus 50*b*, a flat plate passing guide 52 (plate passing guide) is provided between the transfer rolls 11 and spray nozzles with the same structure are arranged above the guide. The plate passing guide 52 above is equipped with holes to pass the cooling water ejected from spray nozzles 53.

If the steel strip 13 to be transferred and each spray nozzle are excessively separated away from each other, the cooling water force is absorbed by fluid existing between the steel strip 13 and the spray nozzle 53 to weaken.

The cooling water force is enhanced at the optimum distance so that the steel strip 13 can pass at a position balancing pressure due to the cooling water ejected from upper surface of the steel strip 13 and pressure due to the cooling water from lower surface. Therefore, this restricts vibration of the steel strip 13 to move the steel strip 13 shifted vertically to the center.

The plate passing guide 52 above may be at a grating or lattice state or be a shape with holes necessary for passing the cooling water at the flat plate.

Next, a cooling step in the cooling apparatus 50 for the steel strip 13 rolled at a continuous finishing mill 3 is described.

The cooling water is ejected from upper and lower spray nozzles 53 comprising the cooling apparatus 50 at latest before the top of the hot rolled steel strip 13 has been transferred from the finishing mill 2E. At this time, an ejection pressure and flow rate are adjusted to equalize the ejecting condition by the spray nozzles 53 acting at the upper and lower surfaces of the steel strip 13.

This equalizes the fluid pressure acting the upper and lower surfaces of the passing steel strip 13 not only eliminating vertical vibration of the steel strip 13 but also limiting a shift to one side for stable centering effect at plate passage.

All of the accompanying roll 51 and the transfer roll 11 can be rotated to wait receiving the steel strip 13. As described before, the rotating direction of the rolls 51 and 11 is set in the direction leading the steel strip 13 from the roll mill 2 to the coiler 4, and the plate is transferred at the peripheral speed equal to or slightly higher than the plate passing speed of the steel strip 13.

The steel strip 13 of 3 mm in thickness delivered from the final finishing mill 2E was passed at a transfer speed by the transfer roll 11 of 650 mpm. The finishing temperature of the steel strip 13 at this time was 890° C.

In the cooling apparatus 50 above, the transfer roll 11 and the accompanying roll 51 are arranged in 8 mm clearance between them, and are rotated at a peripheral speed of 680 mpm.

The steel strip top 13 transferred in the cooling apparatus 50 might be collided with the accompanying roll 51 or the transfer roll 11 but it is smoothly slid in the clearance between the rolls 51 and 11 rotating together. A path line of the steel strip 13 is held constant by the cooling water pressure from upper and lower sides due to upper and lower spray nozzles 53.

On the basis of the condition specified above, a thin steel strip 13 of about 3 mm in thickness can be stably passed from its edge for uniform strong cooling.

A temperature of the steel strip 13 passed the cooling apparatus 50 was 700° C. After that, the steel strip top 13 is guided on the transfer rolls 11 arranged at the downstream side without any vibration and deviation to one side. There is no variation in a temperature of the steel strip 13 during passing, the strip is passed and cooled stably even after rewound by a coiler 4.

Thus, the runout table 3 with the cooling apparatus 50 ensures to realize the same heat history from the steel strip top 13 of 3 mm in thickness to the center area, and followed by subsequent area to the end area. This results in strength and elongation with a little variation in material property throughout the coil product.

The spray nozzles 53 is provided as a cooling nozzle for upper and lower surfaces of the steel strip 13, but a pillar torus laminar type or an ejection type are also acceptable. A centering effect by fluid pressure acting upper and lower surfaced of the steel strip 13 depends on each cooling method so it can be determined on a case by case.

As described above, the accompanying roll 51 has a function of the water breaking roll to prevent the ejected cooling water from flowing out to upstream and downstream sides for cooling with better control ability.

This means that the cooling water if flown out forward and backward from the cooling apparatus 50 causes excessive cooling locally to the steel strip 13. The cooling water flows in the width direction to drop from sides of the steel strip 13, resulting in non-uniform cooling in the width direction. The accompanying roll 51 having a function of the water breaking roll prevents such troubles from occurring.

Figure 11A:
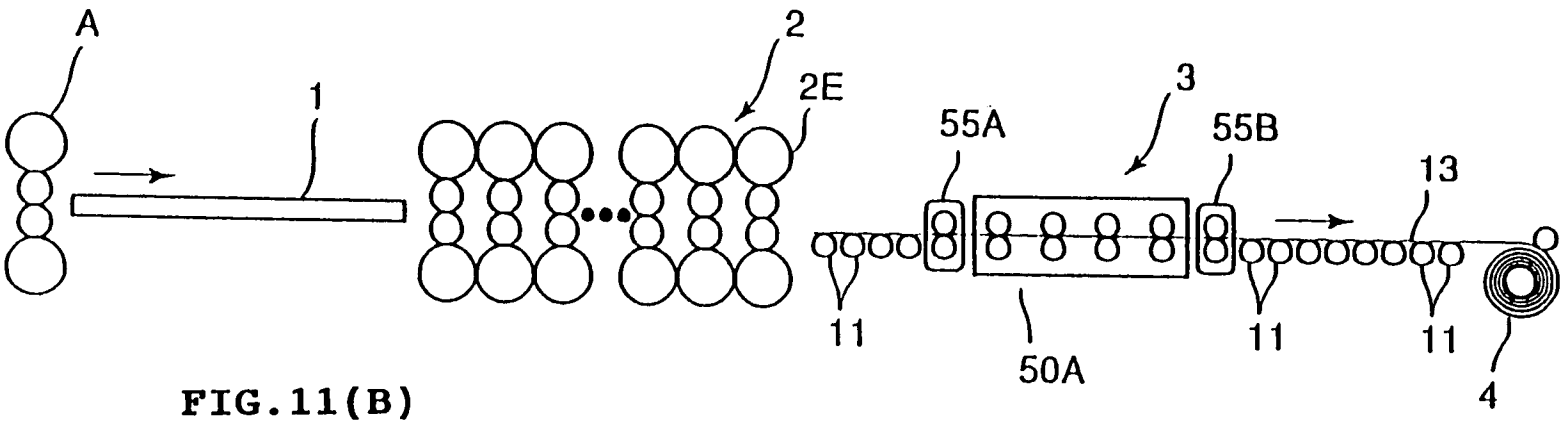
FIG. 11(A) and FIG. 11(B) are schematic drawings of the roll equipment and the cooling apparatus showing the sixth embodiment of the third invention.
Figure 11B:
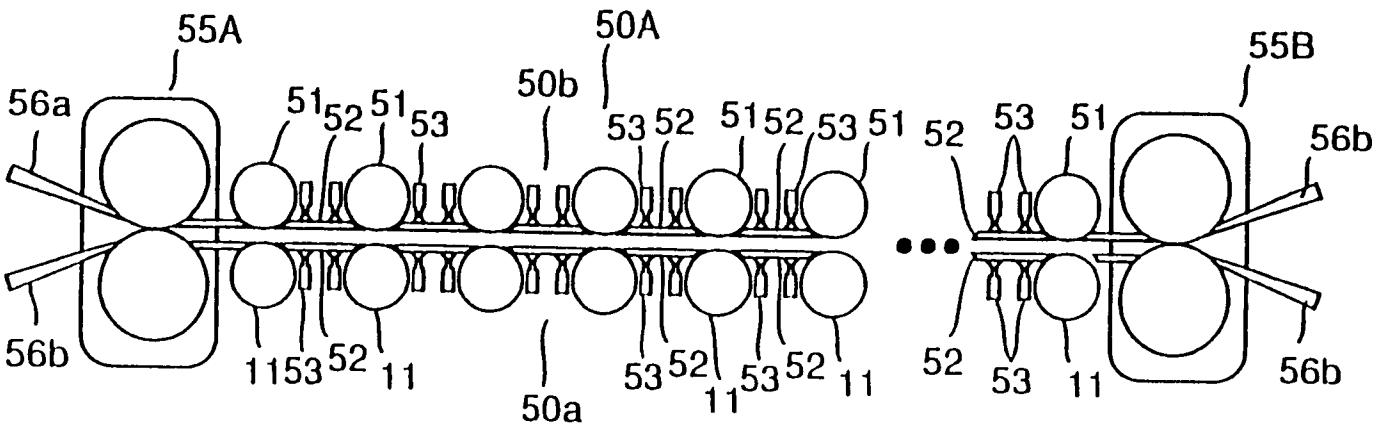

FIG. 11(A) is a schematic drawing of a manufacturing equipment of a hot rolled steel strip at the fifth embodiment, and FIG. 11(B) shows a cooling apparatus (cooling means) at the manufacturing equipment in detail.

The embodiment is a cooling condition for so-called thin hot rolled steel strip of 1.6 mm in thickness with worse plate passing ability than the fifth embodiment. It applies to the situation where a cooling apparatus is arranged at a position away from the final finishing mill and the strip guides and a pair of pinch roll installed at the inlet and outlet sides. The thin hot rolled steel strip above is usually the steel strip of less than 2 mm in thickness.

This means that a rough bar 1 rolled at a roughing mill is transferred on the transfer rolls to roll to the specified thickness by passing seven units of continuous finishing mill 2 and finally is guided to a runout table 3 installed extending to 80 m after the final finishing mill 2E.

The cooling apparatus 50A (cooling means) is arranged around at the center of the runout table 3 where the steel strip 13 is cooled and then rewound by the coiler 4 to form the hot rolled coil.

At the runout table 3, the transfer roll 11 of 300 mm in diameter is arranged continuously as a transfer means at a roll pitch of 350 mm and a cooling apparatus 50A above is provided at the area of 5 m to 20 m from the final finishing mill 2E. The pinch roll pairs 55A and 55B are arranged just before inlet side and after outlet side of the cooling apparatus 50A to pinch the steel strip 13. The steel strip 13 is pinched between these pinch roll pairs 55A and 55B to give tension to the steel strip 13 in concurrence with passage of the steel strip at the pinch roll pairs.

A roll clearance of these pinch roll pairs 55A and 55B rotating in the same direction is specified to plate thickness of the steel strip 13 minus 0.1 mm.

As shown in FIG. 9(B), a pair of upper and lower strip guides 56*a* is installed at the inlet side of the pinch roll pair 55A facing to the roll mill 2. These strip guides 56*a* are arranged at a slant each other with a wider gap between them at the roll mill 2 side to narrow at the pinch roll pair 55A side facing to a rotating area of the roll pair. This enables to smoothly and steadily guide the steel strip top 13 transferred from the roll mill 2.

These pinch roll pairs 55A and 55B have a control function for tension to the steel strip 13 and a regulating function of right and left press force to prevent the steel strip 13 after pinching from meandering.

At this embodiment, a pair of the pinch rolls 55B is arranged just after the cooling apparatus 50A but is not limited to this. It is also effective that a pair may be provided in the cooling apparatus 50A to pinch the transferred steel strip sequentially for cooling with plate passing ability ensured.

At the cooling apparatus 50A, plural transfer rolls 11 are arranged at a pitch of 517 mm. On each transfer roll 11, the accompanying roll 51 which can moves vertically is provided in parallel with the transfer roll 11.

The accompanying roll 51 is rotated in the same direction and at the same peripheral speed as the transfer roll 11. A clearance between each accompanying roll 51 and facing transfer roll 11 is set to plate thickness of the steel strip 13 plus about 5 mm.

A total length of the cooling apparatus 50A itself is about 15 m where thirty sets of the accompanying roll 51 and the transfer roll 11 are installed each. The accompanying roll 51 can move up and down freely to evacuate upward before the steel strip 13 reaches.

The cooling apparatus 50A comprises a cooling apparatus 50*a* located at the lower surface side of the steel strip 13 passed and a cooling system 50*b* at the upper surface side. The lower cooling apparatus 50*a* and the upper cooling apparatus 50*b* are the same structure as those described in FIG. 10(B), so omitting explanation with the same symbols.

Next, a cooling step by the cooling apparatus 50A for the steel strip 13 rolled by the continuous finishing mill 2 is described.

The upper and lower spray nozzles 53 comprising the cooling apparatus 50A eject cooling water at least before the steel strip top 13 is transferred from the continuous finishing mill 2. In this case, an ejection pressure and flow rate are adjusted to equalize an ejecting condition by the spray nozzles 53 acting to upper and lower surfaces of the steel strip 13.

This equalizes the fluid pressure acting the upper and lower surfaces of the passing steel strip 13 not only eliminating vertical vibration of the steel strip 13 but also limiting a shift to one side for stable centering effect at plate passage.

All of the accompanying roll 51 and the transfer roll 11 can rotates to wait receiving the steel strip 13. The rotating direction of the rolls 51 and 11 is set in the direction, for both rolls 8 and 7, leading the steel strip 13 from the roll mill 2 to the coiler 4. The peripheral speed of rolls are determined to be equal to that of the steel strip 13 or slightly higher than the plate passing speed of the steel strip 13 as usual.

The steel strip 13 of 1.6 mm in thickness at the state just transferred from the final finishing mill 2E was passed at a transfer speed of 650 mpm. A finished temperature of the steel strip 13 at this time was 840° C.

In the cooling 50A above, a clearance between the transfer roll 11 and the accompanying roll 51 is set to be 7 mm, both rolls 7 and 8 are rotated at a peripheral speed of 680 mpm.

The steel strip 13 passed from the final finishing mill 2E is guided by the strip guides 56*a* and 56*a*, the top of the strip is held by a pair of pinch rolls 55A for smooth and steady passage.

Tension is given to the steel strip 13 at a moment when the strip is pinched by a pair of pinch rolls 55A at the inlet side.

The steel strip 13 once clamped at its top by a pair of the pinch rolls 55A can be transferred stably.

Then, the steel strip 13 is guided to the initial (first) accompanying roll 51 and the transfer roll 11. In this case, the steel strip top 13 if collided with the accompanying roll 51 above can be smoothly slid to the clearance between the accompanying roll 51 and the transfer roll 11 without any folding or sticking because the accompanying roll 51 rotates and a vertical movement of the steel strip 13 is restricted by a pair of pinch rolls 11A.

In the cooling apparatus 50A, the path line is held constant by the pressure of cooling water ejected from upper and lower surfaces from the upper and lower spray nozzles 53 for stable plate passing and cooling of the steel strip 13.

A temperature of the steel strip 13 after passing the cooling apparatus 50A was 400° C. After that, the steel strip top 13 is pinched again by a pair of pinch rolls 55B at the outlet side being under tension.

The steel strip top 13 passes on the downstream transfer roll 11 until rewinding by the coiler 4. During the step, the steel strip 13 passing the cooling apparatus 50A does not vibrate or shift to one side. There is no variation in temperature of the steel strip top 13 after passing the cooling apparatus 50A, stable passing and cooling are also available even after rewinding the steel strip top 13.

A pair of the pinch rolls 55A is set either to pass the steel strip top 13 reaching a pair of lower pinch rolls 55A for rewinding or to release after rewinding by the coiler 4.

Thus, the runout table 3 with the cooling apparatus 50A ensures to realize the same heat history from the top of the thin steel strip 13 of 1.6 mm in thickness to the center area, and followed by subsequent area to the end area. This results in strength and elongation with a little variation in material property throughout the coil product.

A pair of the pinch rolls 55A provided at the inlet side of the cooling apparatus 50A ensures to firmly guide the steel strip top 13 to the clearance between the first accompanying roll 51 and the transfer roll 11, and to give tension to prevent the steel strip 13 from folding or deforming to an accordion state between he final finishing mill 2E and the cooling apparatus 50A.

A pair of the pinch rolls 55B provided at the outlet side of the cooling apparatus 50A eliminates an influence to the steel strip 13 in the cooling apparatus 50A, even at vibrating the steel strip top during passage of the steel strip 13 from the cooling apparatus 50A to the coiler 4.

The steel strip 13 after clamped by a pair of the pinch rolls 55B is under tension in the cooling apparatus 50A for stable cooling.

Figure 12A:
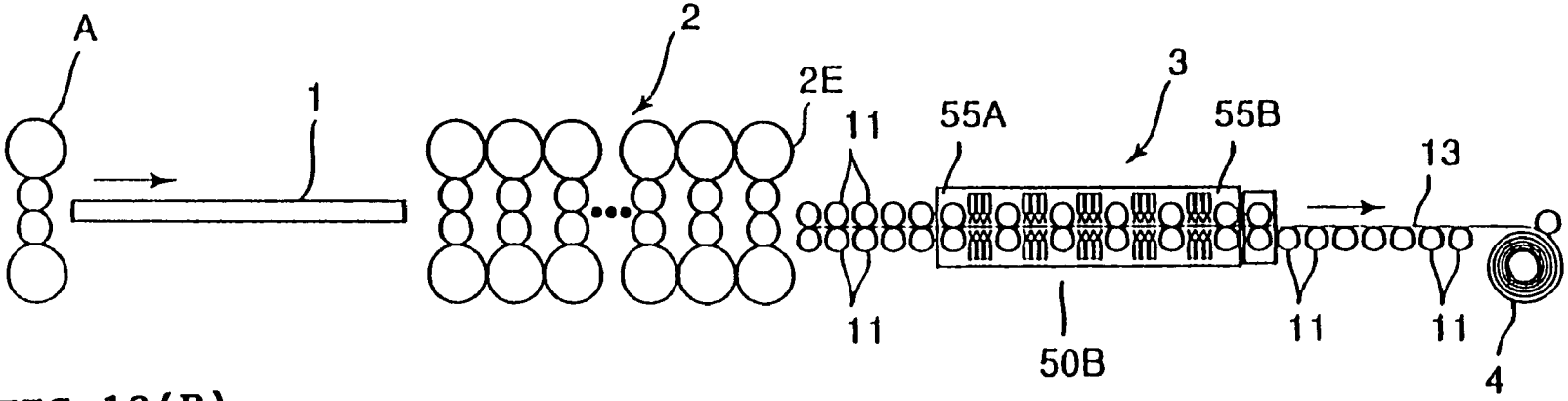
FIG. 12(A) and FIG. 12(B) are schematic drawings of the rolling mill and the cooling apparatus showing the seventh embodiment of the third invention.
Figure 12B:
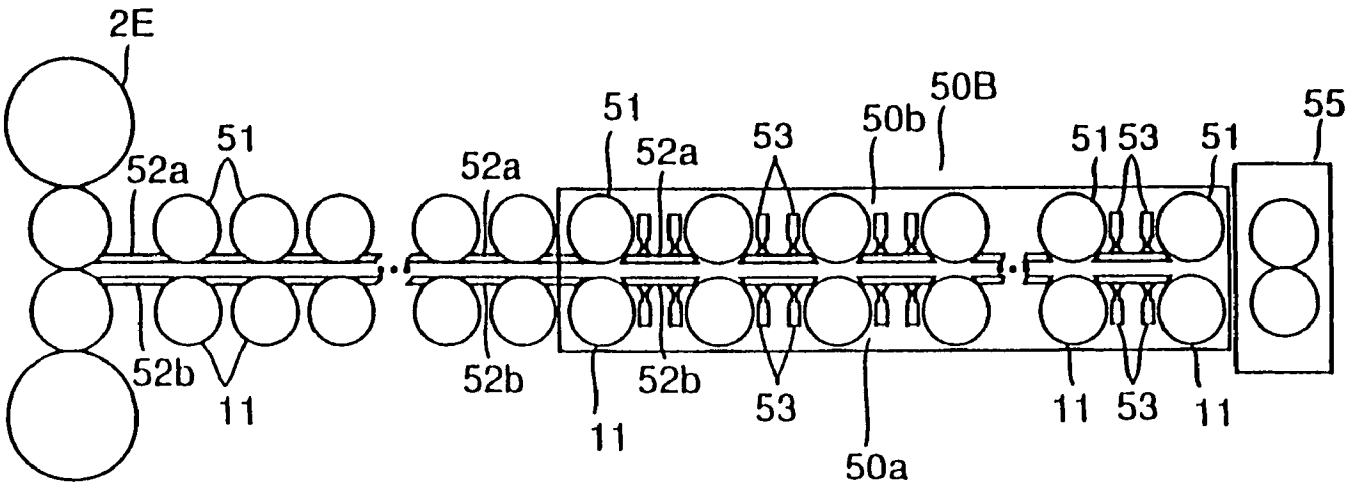

FIG. 12(A) is a schematic drawing of a manufacturing equipment of a hot rolled steel strip at the seventh embodiment, and FIG. 12(B) shows an enlarged section for the entire cooling apparatus (cooling means) including the final finishing mill used for the manufacturing equipment.

The embodiment applies to the situation where a cooling apparatus is arranged just behind a final finishing mill at the condition to cool the hot rolled steel strip of 1.2 mm in thickness worse plate passing ability than the fifth embodiment described before.

This means that a rough bar 1 rolled at a roughing mill A is transferred on the transfer rolls to roll to the specified thickness by passing seven units of continuous finishing mill 2 and finally is guided to a runout table 3 installed behind a final finishing mill 2E.

The cooling apparatus 50B (cooling means) is arranged around at the center of the runout table 3 where the steel strip 13 is cooled and then rewound by a coiler 4 to form the hot rolled coil.

At the runout table 3 above, the transfer rolls 11 of 300 mm in diameter are arranged at the specified interval continuously from a final finishing mill 2E to the coiler through a cooling apparatus 50B. At the inlet side of the cooling apparatus 50B above, various sensors such as a plate thickness gage or a finishing thermometer not shown in drawing.

On the runout table 3, an accompanying rolls 51 rotating in the direction to feed the steel strip 13 from the roll mill 2 to the coiler 4 at the same peripheral speed as the transfer rolls 11 are continuously arranged at the location of 20 m from the final finishing mill 2E.

A pair of the pinch rolls 55 is provided at the position adjacent to the final accompanying roll 51. A pair of the pinch rolls 55 is supported by an up and down moving mechanism rotating with the steel strip 13 to give tension to the strip.

At the cooling apparatus 50B above, the transfer rolls 11 above are continuously arranged at 500 mm interval. Accompanying rolls 51 moving up and down are arranged in parallel with the transfer rolls 11 on them.

Accompanying rolls 51 can rotate in the same direction and at the same peripheral speed as the transfer rolls 11. A clearance between each accompanying roll 51 and its facing transfer roll 11 is set to the plate thickness of the steel strip 13 to be passed plus about 5 mm.

A length from the final finishing mill 2E to the outlet side of the cooling apparatus 50B extends about 20 m in which forty sets of accompanying rolls 51 are provided. The accompanying rolls 51 can be freely elevated vertically so that it can evacuate before the steel strip 13 is transferred.

Plate passing guides (for plate passage) 52*a* are provided between the final finishing mill 2E and the initial (first) accompanying roll 51 and between following accompanying rolls 51 to the final stage of the cooling apparatus 50B.

Plate passing guides (for plate passage) 52*b* are provided between the final finishing mill 2E and the initial (first) transfer roll 51 and between following transfer rolls 51 to the final stage of the cooling apparatus 50B.

Therefore, each guide 52*a* and 52*b* above are arranged at the upper and lower surfaces to the steel strip 13. A clearance between the guides 52*a* and 52*b* is set to relatively narrow to prevent the steel strip top 13 to be passed from scraping up or folding.

The cooling apparatus 50B above is arranged at areas 5 m to 20 m from the outlet side of the final finishing mill 2E and comprises the cooling apparatus 50*a* located at the lower surface of the steel strip 13 and the cooling apparatus 50B located at the upper surface.

In the lower cooling apparatus 50*a*, a spray nozzles 53 are arranged as a cooling nozzle under the plate passing guide 52*b* between each transfer roll 11. The plate passing guide 52*b* is equipped with holes to pass the cooling water.

On the other hand, in the upper cooling apparatus 50*b*, the spray nozzles 53 are arranged as a cooling nozzle above the plate passing guide 52*a* between each transfer roll 11. The plate passing guide 52*a* is equipped with holes to pass the cooling water.

A clearance between the steel strip 13 to be transferred and each spray nozzle 53 if too narrowed than expected will weaken the cooling water force absorbed by water existing between the steel strip 13 and the spray nozzle 53.

The cooling water force is enhanced at the optimum distance so that the steel strip 13 can pass at a position balancing pressure due to the cooling water ejected from upper surface of the steel strip 13 and pressure due to the cooling water from lower surface. Therefore, this restricts vibration of the steel strip 13 to move the steel strip 13 shifted vertically to the center.

Next, a cooling step by the cooling apparatus 50B for the steel strip 13 rolled by the continuous finishing mill 2 is described.

The upper and lower spray nozzles 53 comprising the cooling apparatus 50B eject cooling water at least before the steel strip top 13 is transferred from the continuous finishing mill 2. In this case, an ejection pressure and flow rate are adjusted to equalize an ejecting condition by the spray nozzles 53 acting to upper and lower surfaces of the steel strip 13.

This equalizes the fluid pressure acting the upper and lower surfaces of the passing steel strip 13 not only eliminating vertical vibration of the steel strip 13 but also limiting a shift to one side for stable centering effect at plate passage.

All of the accompanying roll 51 and the transfer roll 11 can be rotated to wait receiving the steel strip 13. The rotating direction of the rolls 51 and 11 is set in the direction, leading the steel strip 13 from the roll mill 2 to the coiler 4. The peripheral speed of rolls are determined to be equal to that of the steel strip 13 or slightly higher than the plate passing speed of the steel strip 13 as usual.

A pair of pinch rolls 55 arranged at the outlet side of the cooling water system 50B above is adjusted to equalize a clearance between rolls each other to the thickness of the steel strip 13 to rotate to the steel strip top transferred from the cooling apparatus 50B.

The steel strip top 13 is a free end without receiving tension at the interval from the final finishing mill 2E to a pair of pinch rolls 55, resulting in vibrating the steel strip 13 freely potentially to cause loose. As a result, the transfer speed is set to 720 mpm to specify the number of rotations of a pair of the pinch rolls 11 with an about 10% lead rate (advance rate of the roll peripheral speed for the transfer speed of the steel strip.) The steel strip 13 of 1.2 mm in thickness after delivered from the final finishing mill 2E is guided at a transfer speed of 650 mpm to the cooling apparatus 50B entering from the top of the strip. In this case, the finishing temperature of the steel strip 13 was 890° C.

In the cooling apparatus 50B, a clearance between the transfer roll 11 and the accompanying roll 51 is set to 6 mm. Both rolls are rotated at a peripheral speed of 680 mpm with a lead rate of 5%.

The steel strip top 13 transferred in the cooling apparatus 50 might be collided with the accompanying roll 51 or the transfer roll 11 but it is smoothly slid in the clearance between the rolls 51 and 11 rotating together.

Vertical vibration of the steel strip 13 is restricted by the upper and lower plate passing guides 52*a* and 52*b* provided between the accompanying rolls 51 and between the transfer rolls 11 each other at the interval from the final finishing mill 2E and the cooling apparatus 50B. In addition, a path line of the steel strip 13 is held constant by the cooling water pressure at the upper and lower surfaces due to the upper and lower spray nozzles 53.

These various conditions realize a stable plate passing at the steel strip top 13 for uniform strong cooling even at the thin steel strip 13 of 1.2 mm in thickness.

The steel strip top 13 once reaching a pair of the pinch rolls 55 after leaving the cooling apparatus 50B then pinched there causes a tension to upstream steel strip with stably balanced.

A temperature of the steel strip 13 near a pair of the pinch rolls 55 passing the cooling apparatus 50B was 700° C. The steel strip 13 is transferred by the lower transfer rolls 11 at the interval from a pair of the pinch rolls 55 until the steel strip top is rewound by the coiler 4, without vibration or shift to one side of the steel strip 13 at passing the cooling apparatus 50B. This stabilizes cooling to the steel strip 13 eliminating variation in temperature of the steel strip at the outlet of the cooling apparatus 50B.

A pair of the pinch rolls 55 is separated from each other to release by timing of the steel strip top 13 reaching the coiler 4. Additional tension occurs to the steel strip 13 along with rewinding by the coiler 4, resulting in stable and continuous plate passing and cooling.

This concludes that the hot rolled steel strip is transferred ejecting the cooling water at the specified ejecting condition to pinch the steel strip top by a pair of the pinched rolls just after the inlet and/or outlet sides of the cooling apparatus and/or at the half way of the cooling, and that the steel strip top is then released from a pair of the pinch rolls at upstream side sequentially concurrently with reaching a tension giving means such as a pair of the pinch rolls at downstream side or the coiler.

Thus, the same heat history can be realized by comprising the runout table 3 with the cooling apparatus 50B at the interval from the steel strip top to the center area and to the final end section. This results in a coil product with a little variation in quality and with a uniform strength and elongation.

The spray nozzles 53 are used as a cooling nozzle at upper and lower surfaces of the steel strip 13, but not limited to this, a pillar tube laminar type or an ejection type are also acceptable. A centering condition due to fluid pressure acting at upper and lower surfaces of the steel strip 13 depends on an individual cooling condition so it may be determined reflecting the cooling condition.

At the fifth through seventh embodiments above, the reason why the clearance between the accompanying roll 51 and the transfer roll 11 was set to a plate thickness of the steel strip 13 plus about 5 mm is based on the following.

It is because if the clearance between the accompanying roll 51 and the transfer roll 11 is set to the same thickness as or less than that of the steel strip 13, the accompanying roll 51 is loaded. A stable plate passing requires a detailed rotation number control for the accompanying roll 51, which results in meandering of the steel strip 13 thereafter if a press force to both bearings to support the accompanying roll 51 is not balanced.

Therefore, pinching the accompanying roll 51 to the steel strip 13 requires a relatively complicated function in equipment and functional requirement. On the other hand, the clearance if expanded to the value of plate thickness of the steel strip plus 30 mm or more will deteriorate stable plate passage due to significant vertical vibration at passing of the steel strip top 13.

This specifies the clearance between the accompanying roll 51 and the transfer roll 11 to the thickness of the passing plate plus 30 mm. Preferably, the plate thickness of the steel strip 13 plus about 5 mm is a best choice.

(Comparison Example)

In the manufacturing equipment with the same figure as the fifth through seventh embodiments, eight examples were compared as follows.

A comparison 1 is a case where the accompanying roll and the plate passing guide at the fifth embodiment are not provided but alternatively the spray nozzles are arranged at the same position to transfer the steel strip of 3 mm in thickness to the cooling apparatus to cool the top by ejecting the cooling water.

A comparison 2 is a case where the accompanying roll at the fifth embodiment is provided but the accompanying roll is not provided, and alternatively the spray nozzles are arranged at the same position to transfer the steel strip of 3 mm in thickness to the cooling apparatus to cool the top by ejecting the cooling water.

A comparison 3 is a case where the hot rolled steel strip of 1.6 mm in thickness is transferred to the cooling apparatus to cool the top with a similar equipment configuration to the fifth embodiment.

A comparison 4 is a case where the strip guide provided at the inlet side of the cooling apparatus at the sixth embodiment is not arranged at the sixth embodiment. A comparison 5 is a case where no pinch rolls pair are arranged at the inlet side at the sixth embodiment as like. A comparison 6 is a case where no pinch rolls pair are arranged at the outlet side at the sixth embodiment as like.

A comparison 7 is a case where no accompanying roll is provided at the interval 5 m from the roll mill at the seventh embodiment. A comparison 8 is a case where no plate passing guide is arranged at the interval 5 m from the roll mill.

These results are summarized in Table 1.

TABLE 1

| | Plate | Roll mill, till 5 | | | Pinch rolls | Roll mill, 5 to 15 m | | Pinch | Plate |
|---|---|---|---|---|---|---|---|---|---|
| | thickness of steel strip | Accompanying roll | Plate passing guide | Strip guide | pair at the inlet | Accompanying roll | Plate passing guide | rolls at outlet | passing ability |
| Best mode 5 | 3 | X | X | X | X | ○ | ○ | X | ○ |
| Best mode 6 | 1.6 | X | X | ○ | ○ | ○ | ○ | ○ | ○ |
| Best mode 7 | 1.2 | ○ | ○ | X | X | ○ | ○ | ○ | ○ |
| Comparative example 1 | 3 | X | X | X | X | X | X | X | X |
| Comparative example 2 | 3 | X | X | X | X | ○ | X | X | X |
| Comparative example 3 | 1.6 | X | X | X | X | ○ | ○ | X | X |
| Comparative example 4 | 1.6 | X | X | X | ○ | ○ | ○ | ○ | X |
| Comparative example 5 | 1.6 | X | X | ○ | X | ○ | ○ | X | X |
| Comparative example 6 | 1.6 | X | X | ○ | ○ | ○ | ○ | X | X |
| Comparative example 7 | 1.2 | X | ○ | X | X | ○ | ○ | ○ | X |
| Comparative example 8 | 1.2 | ○ | X | X | X | ○ | ○ | ○ | X |

In comparison 1, no limiting means provided at the interval from the final finishing mill to the inlet of the cooing system causes significant vertical vibration due to collision of the steel strip top to the transfer roll at plate passing even for the steel strip having an intermediate thickness of 3 mm. The steel strip top failed to be clamped between the first cooling nozzle of the cooling system and the transfer roll, resulting in damage of the nozzles due to collision of the steel strip to the cooling nozzle.

The cooling water leaked from the clearance between the accompanying roll and the steel strip is desirable to blow off from one edge of the steel strip just after the accompanying roll using high pressure water ejected from the water breaking spray as shown in FIG. 7.

As a result, there is no or little cooling water remaining on the steel strip just after the accompanying roll to eliminate excessive cooling due to remaining water a uniform temperature distribution after cooling of each part of the steel strip. Detailed survey of material property in the longitudinal direction of the steel strip shows that the steel strip with a complete uniform grain size was stably obtained.

In comparison 2, the top of the steel if clamped by the first accompanying roll might be rushed to the clearance between the accompanying roll and the cooling nozzles because of no plate guide, failing to stable plate passing.

In comparison 3, the steel strip top if clamped between the first accompanying roll and the transfer roll enables the stable plate passing and cooling because the accompanying roll and the plate passing guide are available. The plate thickness is, however, thinner than the fifth embodiment so that the plate rigidity becomes small to escalate vibration, finally to stick the plate in an accordion-like state after reaching the cooling apparatus.

In comparison 4, a pair of the pinch rolls for the steel strip was provided at the inlet and outlet sides of the cooling apparatus in comparison 3, but the steel strip top occasionally failed to be clamped between the pinch rolls because of no strip guide, resulting in an accordion-like stick after reaching the cooling apparatus.

In comparison 5, the strip guide was provided at the inlet side of the cooling apparatus in comparison 3, but the steel strip was transferred whose top was kept free from the finishing mill to the cooling apparatus because of no pinch rolls pair at the inlet. This causes an accordion-like stick accumulating the loose of the steel strip generated from the roll mill to the cooling apparatus.

In comparison 6, the strip guide was provided at the inlet side of the cooling apparatus and the pinch rolls pair at the outlet side, but the steel strip was transferred whose top was kept free from the finishing mill to the cooling apparatus because of no pinch rolls pair at the inlet. This causes an accordion-like stick accumulating the loose of the steel strip generated from the roll mill to the cooling apparatus.

In comparison 7, the strip guide and pinch rolls pair were provided at the inlet side of the cooling apparatus, but the strip was loosened between the finishing mill and the cooling apparatus and within the cooling apparatus, finally accumulating to an accordion-like stick.

The loose can be recovered to some extent by setting the number of rotations of he pinch rolls pair with the lead rate, but not removed completely by either of pinch rolls pair or removed only after a long period. During the period, the steel strip is not stable, vibrates or contacts the guide to generate many problems such as flaw damage.

Comparison 8 is a case where there is no accompanying roll at the distance of 5 m from the roll mill at the seventh embodiment and comparison 9 is a case where no plate passing guide is provided. In both cases, the steel strip top of 1.2 mm in thickness was stuck to fail stable plate passing.

As described above, this invention can realize the following effect.

(1) The steel strip can be cooled at a uniform cooling condition from top to end of the steel strip especially ensuring a constant cooling stop temperature in both longitudinal and width directions to reduce variation in material property, resulting in the uniform and flaw-less steel strip with stabilized quality. Along with this merit, a cutting allowance at the top is reduced to raise the yield rate.

(2) The steel strip even when passing the cooling apparatus under no tension can stably move causing a little troubles such as stick or operation stop.

(3) The steel strip even when transferred unstably until its top section is rewound by the coiler can stably move in the cooling apparatus for uniform cooling. This results in uniform material property to raise the yield rate. In particular, the stable plate passage and complete cooling are ensured for the thin steel strip less than 2 mm in thickness.

(4) A length of the steel strip transferred and cooled under no tension can be shortened to eliminate variation in material property due to uniform cooling equal to the center of the steel strip. Stabilized transfer of the steel strip during cooling is effective to reduce troubles such as sticking and operation stop.

What is claimed is:

1. An apparatus for cooling a hot rolled steel strip comprising:

a transfer means arranged behind a final finishing mill of manufacturing equipment for producing a hot rolled steel strip, said transfer means comprising a plurality of transfer rolls located at a specified interval for transferring the hot rolled steel strip;

at least one upper surface cooling means arranged at an upper surface side of the transfer means, for cooling the hot rolled steel strip by ejecting cooling water to an upper surface of the hot rolled steel strip, said upper surface cooling means being capable of moving freely up and down and having a water breaking means at least at an outlet side of the apparatus for cooling and at a position corresponding to the transfer rolls; and at least one lower surface cooling means arranged at a lower surface side of the transfer means relative to the upper surface cooling means and the hot rolled steel strip to be transferred for cooling the hot rolled steel strip by ejecting cooling water at a lower surface of the hot rolled steel strip.

2. The apparatus according to claim 1, wherein said water breaking means comprises water breaking rolls.

3. The apparatus according to claim 1, wherein the upper surface cooling means and the lower surface cooling means have a flat surface facing the hot rolled steel strip.

4. A plurality of apparatuses according to claim 1, which are arranged along the direction of travel of the hot rolled steel sheet.

5. An apparatus for cooling a hot rolled steel strip comprising:

a transfer means arranged behind a final finishing mill of manufacturing equipment for producing a hot rolled steel strip, said transfer means comprising a plurality of transfer rolls located at a specified interval for transferring the hot rolled steel strip;

at least one upper surface cooling means arranged at an upper surface side of the transfer means, for cooling the hot rolled steel strip by ejecting cooling water to an upper surface of the hot rolled steel strip, said upper surface cooling means being capable of moving freely up and down and having a water breaking means at least at an outlet side of the apparatus for cooling and at a position corresponding to the transfer rolls; and at least one lower surface cooling means arranged at a lower surface side of the transfer means relative to the upper surface cooling means and the hot rolled steel strip to be transferred for cooling the hot rolled steel strip by ejecting cooling water at a lower surface of the hot rolled steel strip, wherein said water breaking means comprises water breaking rolls and, wherein the water breaking rolls have the same peripheral speed as the transfer rolls.

6. The apparatus according to claim 1, wherein the upper surface cooling means and the lower surface cooling means are arranged at a position facing each other through the hot rolled steel strip.

7. A method for cooling a hot rolled steel strip comprising:

pinching an upper surface and a lower surface of a hot rolled steel strip by water breaking rolls and transfer rolls behind a final finishing mill of manufacturing equipment for producing the hot rolled steel strip when a top end of the hot rolled steel strip passes through the water breaking rolls and transfer rolls;

cooling the hot rolled steel strip by ejecting cooling water at a specified condition from the upper surface and the lower surface of the hot rolled steel strip during said pinching step.

8. A method for cooling a hot rolled steel strip comprising:

pinching an upper surface and a lower surface of a hot rolled steel strip by water breaking rolls and transfer rolls behind a final finishing mill of manufacturing equipment for producing the hot rolled steel strip when a top end of the steel strip passes through the water breaking rolls and transfer rolls; and cooling the hot rolled steel strip by ejecting cooling water simultaneously during the pinching step so that a fluid pressure acting on the upper surface of the hot rolled steel strip and a fluid pressure acting on the lower surface of the hot rolled steel strip is substantially the same.

9. A method for cooling a hot rolled steel strip comprising:

pinching a hot rolled steel strip with a water breaking roll and a transfer roll by lowering the water breaking roll to contact a top end of the steel strip with the water breaking roll behind a final finishing mill of manufacturing equipment for producing the hot rolled steel strip when the top end of the steel strip passes through the water breaking rolls and transfer rolls, the water breaking rolls and the transfer rolls having the same peripheral speed; and cooling the hot rolled steel strip by ejecting cooling water simultaneously during the pinching step so that a fluid pressure acting on the upper surface of the hot rolled steel strip and a fluid pressure acting on the lower surface of the hot rolled steel strip is substantially the same.

10. The method for manufacturing a hot rolled steel strip comprising:

heating a slab to provide a heated slab;

rough rolling the heated slab into a rough rolled bar;

finish rolling the rough rolled bar into a finish rolled steel strip;

cooling the finish rolled steel with the cooling apparatus according to claim 1; and coiling the cooled steel strip.

11. A method for manufacturing a hot rolled steel strip comprising:

heating a slab to provide a heated slab;

rough rolling the heated slab into a rough rolled bar;

finish rolling the rough rolled bar into a finish rolled steel strip;

cooling the finish rolled steel strip by the method for cooling according to claim 7; and coiling the cooled steel strip.

12. A method for manufacturing a hot rolled steel strip comprising:

heating a slab to provide a heated slab;

rough rolling the heated slab into a rough rolled bar;

finish rolling the rough rolled bar into a finish rolled steel strip;

cooling the finish rolled steel strip by the method for cooling according to claim 8; and coiling the cooled steel strip.

13. A method for manufacturing a hot rolled steel strip comprising:

heating a slab to provide a heated slab;

rough rolling the heated slab into a rough rolled bar;

finish rolling the rough rolled bar into a finish rolled steel strip;

cooling the finish rolled steel strip by the method for cooling according to claim 9; and coiling the cooled steel strip.

* * * * *